US012031263B2

(12) United States Patent
Lee et al.

(10) Patent No.: US 12,031,263 B2
(45) Date of Patent: Jul. 9, 2024

(54) LAUNDRY TREATMENT APPARATUS

(71) Applicant: LG Electronics Inc., Seoul (KR)

(72) Inventors: Jihong Lee, Seoul (KR); Yeongho Jeong, Seoul (KR); Minsu Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 17/406,681

(22) Filed: Aug. 19, 2021

(65) Prior Publication Data

US 2022/0120021 A1 Apr. 21, 2022

(30) Foreign Application Priority Data

Oct. 15, 2020 (KR) ..... 10-2020-0133462

(51) Int. Cl.
*D06F 39/08* (2006.01)
*D06F 37/04* (2006.01)
*D06F 39/12* (2006.01)

(52) U.S. Cl.
CPC ..... *D06F 39/088* (2013.01); *D06F 37/04* (2013.01); *D06F 39/12* (2013.01)

(58) Field of Classification Search
CPC ..... D06F 39/088
See application file for complete search history.

(56) References Cited

FOREIGN PATENT DOCUMENTS

| | | |
|---|---|---|
| EP | 2949803 | 12/2015 |
| EP | 3064637 | 9/2016 |
| EP | 3112524 | 1/2017 |
| WO | WO2017003182 | 1/2017 |

OTHER PUBLICATIONS

Extended European Search Report in European Appln. No. 21190981.7, dated Jan. 31, 2022, 9 pages.

*Primary Examiner* — Jason Y Ko
(74) *Attorney, Agent, or Firm* — Fish & Richardson P.C.

(57) ABSTRACT

A laundry treatment apparatus includes a cabinet with an entrance, a drawer provided to be withdrawable from the cabinet through the entrance, a tub provided inside the drawer to provide a space for storing water, a height of the tub being smaller than a width of the tub, a water supply unit communicating with the tub to supply water, and a drum including a drum body rotatably provided inside the tub and a drum introduction port provided at an upper portion of the drum body and opened to allow laundry to be introduced. The tub includes a tub body, a tub cover, a tub introduction port, and an inflow portion provided at any one of the tub cover and the tub body. The inflow portion is disposed at an outer side of the drum introduction port to prevent the inflow portion from facing the drum introduction port.

19 Claims, 18 Drawing Sheets

LAUNDRY TREATMENT APPARATUS

CROSS-REFERENCE TO RELATED APPLICATION

This application claims the benefit of Korean Patent Application No. 10-2020-0133462, filed on Oct. 15, 2020, which is hereby incorporated by reference as if fully set forth herein.

TECHNICAL FIELD

The present disclosure relates to a laundry treatment apparatus.

BACKGROUND

In general, a laundry treatment apparatus conceptually includes an apparatus for washing laundry, an apparatus for drying laundry, and an apparatus for performing both washing and drying of laundry.

In the case of a front-loading type laundry treatment apparatus (so-called drum washing machine) in which laundry is put thereinto from a front side thereof, an introduction port through which laundry is introduced into the apparatus is positioned at a level lower than the waist of a user, so that the user inconveniently needs to stoop down in order to put laundry into the apparatus or take laundry out of the apparatus.

To eliminate such inconvenience, some conventional laundry treatment apparatuses have raised the height of the introduction port by adding a support stand to the bottom of the front-loading type laundry treatment apparatus.

However, the support stand provided in the conventional laundry treatment apparatus is only a means for raising the introduction port of the laundry treatment apparatus and has a disadvantage of being incapable of implementing a laundry treatment function such as washing or drying of laundry.

Korean Patent Laid-Open Publication No. 10-2015-0138017 discloses a laundry treatment apparatus including a cabinet, a drawer retractably provided in the cabinet, and an accommodation unit provided inside the drawer to provide a space for treating laundry such as washing or drying.

However, the above laundry treatment apparatus has a disadvantage in that an inflow portion through which water is supplied into a tub is clogged by laundry because the inflow portion is provided at the tub to face a drum introduction port. In addition, there is a disadvantage in that a sanitary state may deteriorate or the inflow portion may corrode because bubbles, etc. generated by a detergent flow into the inflow portion.

Meanwhile, Korean Patent Laid-Open Publication No. 10-2017-0135209 discloses a laundry treatment apparatus including a communication hole for preventing negative pressure generated by sealing the inside of a tub by a door.

However, the above laundry treatment apparatus has a disadvantage in that the communication portion is blocked by laundry because the communication hole is provided at a tub to face a drum introduction port. In addition, there is a disadvantage in that a sanitary state may deteriorate or the communication hole may corrode because bubbles, etc. generated by a detergent flow to the outside through the communication hole.

SUMMARY

Accordingly, the present disclosure is directed to a laundry treatment apparatus that substantially obviates one or more problems due to limitations and disadvantages of the related art.

An object of the present disclosure is to provide a laundry treatment apparatus for performing washing or drying of laundry.

Another object of the present disclosure is to provide a laundry treatment apparatus for separately disposing an inflow portion provided at a tub to supply water into the tub in an outer direction of a drum introduction port to prevent the inflow portion from being clogged by introduced laundry.

A further object of the present disclosure is to provide a laundry treatment apparatus for separately disposing, in an outer direction of a drum introduction port, a communication connection portion provided at a tub to prevent the inside of the tub from being sealed by causing the inside of the tub and the outside of a cabinet to communicate with each other to prevent the communication connection portion from being clogged by introduced laundry.

In a laundry treatment apparatus according to an embodiment of the present disclosure for achieving the above objects, an inflow portion for supplying water to the inside of a tub may be provided to be spaced apart in an outer direction of a drum introduction port. The inflow portion may be prevented from being clogged by laundry during washing. The inflow portion may prevent bubbles and foreign substances generated during washing from being discharged to the outside therethrough.

In addition, in a laundry treatment apparatus according to an embodiment of the present disclosure for achieving the above objects, a communication connection portion through which the inside of a tub and the outside of a cabinet communicate with each other may be provided to be spaced apart in an outer direction of a drum introduction port. The communication connection portion may be prevented from being clogged by laundry during washing. The communication connection portion may prevent bubbles and foreign substances generated during washing from being discharged to the outside through an inflow portion.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry treatment apparatus includes a cabinet provided at a front portion thereof with an entrance, a drawer provided to be withdrawable from the cabinet through the entrance, a tub provided inside the drawer to provide a space for storing water, a height of the tub being smaller than a width of the tub, a water supply unit communicating with the tub to supply water, and a drum including a drum body rotatably provided inside the tub and a drum introduction port provided at an upper portion of the drum body and opened to allow laundry to be introduced. The tub may include a tub body in which the drum body is accommodated, a tub cover coupled to an upper surface of the tub body and configured to shield the tub body, a tub introduction port provided at the tub cover and configured to cause the drum introduction port and the drawer to communicate with each other, and an inflow portion provided at any one of the tub cover and the tub body and connected to the water supply unit. The inflow portion may be disposed at an outer side of the drum introduction port to prevent the inflow portion from facing the drum introduction port.

The inflow portion may be provided to extend from a side surface of the tub cover.

The tub cover may include a cover body provided with the tub introduction port, and a body coupling portion extending downward from the cover body and coupled to the tub body, and inflow portion may include an inflow guide provided by passing through the body coupling portion and connected to the water supply unit.

The inflow portion may further include an inflow protrusion protruding towards an upper surface of the drawer from the cover body and having an open lower surface, and the inflow guide may have one end located inside the inflow protrusion.

The inflow guide may include a first inflow guide extending from the one end and passing through the body coupling portion, and a second inflow guide extending to an outer side of the body coupling portion from the first inflow guide and connected to the water supply unit. A diameter of the second inflow guide may be larger than a diameter of the first inflow guide.

A highest height of the first inflow guide from a lower surface of the tub may be equal to a highest height of the second inflow guide from the lower surface of the tub, and a lower end of the second inflow guide may be provided below a lower end of the first inflow guide to extend from the body coupling portion.

The inflow protrusion may be provided to be inclined in a radial direction of the cover body.

The inflow portion may be provided to extend from an upper surface of the tub cover.

The inflow portion may be spaced apart from the tub introduction port in a rear direction to prevent the water supply unit from being exposed to an outer side of the cabinet when the drawer is withdrawn.

The laundry treatment apparatus may further include a balancer coupled to the drum introduction port to reduce vibration and having an open upper surface through which the drum introduction port and the tub introduction port communicate with each other, and the inflow portion may be disposed outside an upper surface of the balancer to prevent the inflow portion from facing the upper surface of the balancer.

The inflow portion may be provided at the tub body, and a height of the inflow portion from a lower surface of the tub body may be higher than a highest water level of the tub body.

The laundry treatment apparatus may further include a communication port through which the outside of the cabinet and the tub communicates with each other, and a communication connection portion provided at any one of the tub body and the tub cover and connected to the communication portion. The communication connection portion may be disposed at the outer side of the drum introduction port to prevent the communication connection portion from facing the drum introduction port.

The communication connection portion may be provided to extend from a side surface of the tub cover.

The communication connection portion may include a communication guide provided by passing through the body coupling portion and connected to the communication portion.

The communication connection portion may further include a communication protrusion protruding towards an upper surface of the drawer from the cover body and having an open lower surface, and the communication guide may have one end located inside the communication protrusion.

The communication connection portion may be spaced apart from the inflow portion by a predetermined distance in a circumferential direction of the tub cover.

The communication connection portion may be disposed outside an upper surface of the balancer to prevent the communication connection portion from facing the upper surface of the balancer.

The laundry treatment apparatus may further include a drain unit provided at the tub to discharge water stored in the tub to an outer side of the cabinet. The drain unit may include a drain pump provided at the drawer, a first drain tube configured to guide water stored in the tub to the drain pump, and a second drain tube configured to guide water discharged from the drain pump to the outer side of the cabinet. The communication portion may include a drain communication tube through which the communication portion and the drain pump communicate with each other.

The communication connection portion may be provided to extend from an upper surface of the tub cover.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
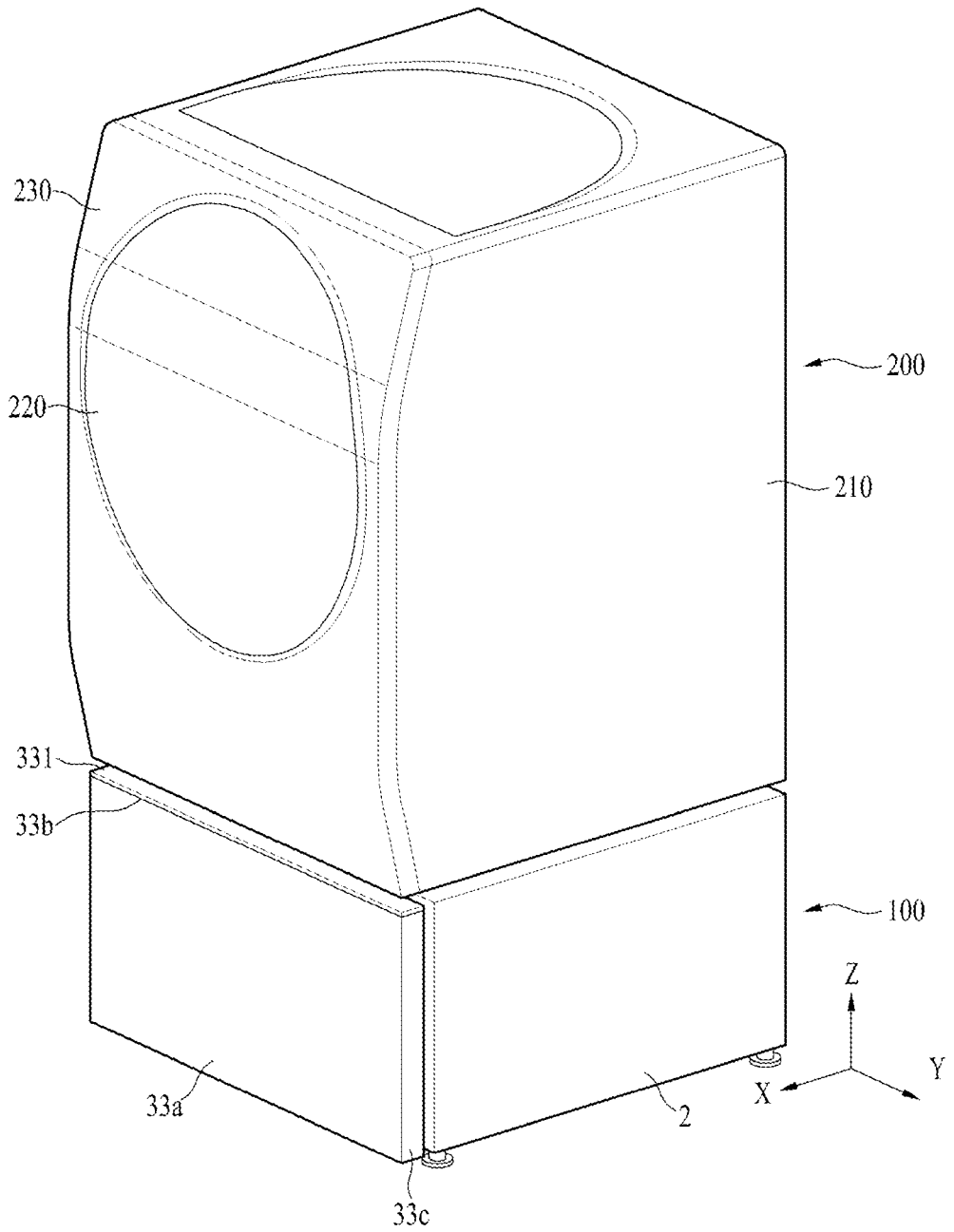
FIG. 1 is a perspective view of a laundry treatment apparatus according to an embodiment of the present disclosure.

Hereinafter, embodiments of the present disclosure will be described in detail with reference to the accompanying drawings so that the present disclosure may be easily realized by those skilled in the art.

However, the present disclosure is not limited to the embodiments described herein and may be achieved in various different forms. In the drawings, parts that are not related to a description of the present disclosure are omitted to clearly explain the present disclosure and similar reference numbers will be used throughout this specification to refer to similar parts.

In this specification, a redundant description of the same component is omitted.

In this specification, it should be understood that, when an element is referred to as being "connected to" or "coupled to" another element, the element may be directly connected to or coupled to the other element or intervening elements may also be present. In contrast, it should be understood that, when an element is referred to as being "directly connected to" or "directly coupled to" another element, no intervening elements are present.

The terms used in this specification are used to merely describe specific embodiments and are not intended to limit the present disclosure.

In this specification, a singular representation may include a plural representation unless it represents a definitely different meaning from the context.

In this specification, terms such as "include" or "has" are intended to indicate the presence of features, numbers, steps, operations, elements, components, or combinations thereof used herein and it should be thus understood that the possibility of presence or addition of one or more different features, numbers, steps, operations, elements, components, or combinations thereof is not excluded.

In this specification, the term "and/or" includes any and all combinations of one or more of the associated listed items. In this specification, "A or B" may include "A", "B", or "both A and B".

Referring to the Cartesian coordinate system illustrated in FIG. 1, a front direction is defined as a positive X-axis direction, a rear direction is defined as a negative X-axis direction, a right direction is defined as a positive Y-axis direction, a left direction is defined as a negative Y-axis direction, an upper direction is defined as a positive Z-axis direction, and a lower direction is defined as a negative Z-axis direction. That is, a width direction is defined as a Y-axis direction, and a height direction is defined as a Z-axis direction.

Figure 2:
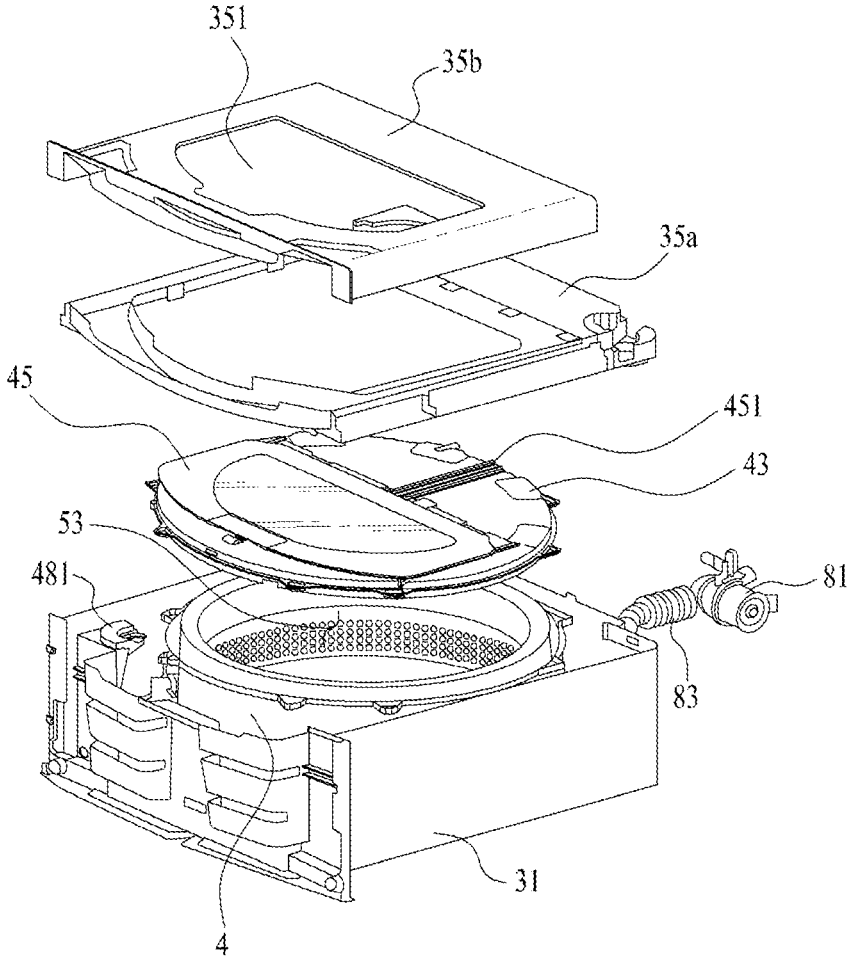
FIG. 2 is an exploded view of a laundry treatment apparatus according to an embodiment of the present disclosure.

FIG. 1 is a perspective view of a laundry treatment apparatus according to an embodiment of the present disclosure. FIG. 2 is an exploded view of a laundry treatment apparatus according to an embodiment of the present disclosure.

Referring to FIGS. 1 and 2, the laundry treatment apparatus according to an embodiment of the present disclosure may be provided with only a first treatment apparatus 100 or with the first treatment apparatus 100 and a second treatment apparatus 200 positioned above the first treatment apparatus 100. Hereinafter, for convenience of description, a laundry treatment apparatus equipped with both the first treatment apparatus 100 and the second treatment apparatus 200 will be described.

The first treatment apparatus 100 may be provided as an apparatus that implements a laundry treatment function such as washing or drying of laundry (or objects to be washed or objects to be dried), and the second treatment apparatus 200 may be provided as an apparatus that is detachably provided on the first treatment apparatus 100 to implement the laundry treatment function.

The second treatment apparatus 200 may include a second cabinet 210 that forms an outer appearance and a second laundry accommodation unit (not shown) disposed inside the second cabinet 210 to provide a space for washing or drying of laundry.

The second laundry accommodation unit may include a second tub (not shown) disposed inside the second cabinet 210 to store water and a second drum (not shown) rotatably disposed inside the second tub to provide a space for storing laundry.

The second treatment apparatus 200 may further include a second water supply unit (not shown) for supplying water to the second tub and a second drain unit (not shown) for discharging water stored in the second tub to the outside of the second cabinet 210.

The second cabinet 210 is provided with a second treatment apparatus introduction port (not shown) through which laundry is introduced into the second cabinet 210 and taken out of the second cabinet 210. The second treatment apparatus introduction port is opened and closed by a second treatment apparatus door 230 hinged to the second cabinet 210.

The second treatment apparatus door 230 may be provided with a window 220 that allows a user to check the inside of the second drum from the outside of the laundry treatment apparatus.

The second treatment apparatus introduction port communicates with the inside of the second drum through a second tub introduction port provided at the second tub and a second drum introduction port provided at the second drum. Accordingly, the user may put laundry into the second drum or take laundry stored in the second drum out of the second cabinet 210 by opening the second treatment apparatus door 230.

When the second treatment apparatus 200 is provided to perform a laundry drying function as well, a second hot air supply unit (not shown) for supplying heated air to the second tub should be further provided inside the second cabinet 210.

The second hot air supply unit (not shown) may include a circulation duct for circulating air inside the second tub and a heat exchange unit provided inside the circulation duct to dehumidify and heat air discharged from the second tub.

However, the second hot air supply unit (not shown) may include a discharge duct for discharging air inside the second tub to the outside of the second cabinet 210, a supply duct for supplying air outside the second tub to the second tub, and a heat exchange unit disposed at the supply duct to heat air flowing into the supply duct.

Unlike the above construction, if the second treatment apparatus 200 is provided to perform only a laundry drying function, the second tub in the second treatment apparatus 200 may be omitted. In this case, a means for rotatably supporting the drum should be further provided inside the second treatment apparatus 200, and the above second hot air supply unit should be provided to supply hot air to the second drum.

The first treatment apparatus 100 provided in the laundry treatment apparatus according to an embodiment of the present disclosure includes a cabinet 2 detachably provided at the second treatment apparatus cabinet 210, a drawer 3 disposed in the cabinet to be withdrawable therefrom and retractable thereinto, and an accommodation unit 4 and 5 disposed inside the drawer to provide a laundry treatment space.

The cabinet 2 forms an outer appearance of the first treatment apparatus 100 and may support the second treatment apparatus cabinet 210. Unlike FIG. 1, the cabinet 2 provided at the first treatment apparatus may be detachably provided at an upper surface or a side surface of the second treatment apparatus cabinet 210.

However, when the first treatment apparatus 100 is positioned under the second treatment apparatus 200, since the height of the second treatment apparatus door 230 is increased, it is convenient for the user to put laundry into the treatment apparatus or to take laundry out of the treatment apparatus.

The cabinet 2 includes an entrance 21. The drawer 3 may be withdrawn from or inserted into the cabinet 2 through the entrance 21. The cabinet 2 desirably has the length of a width direction (Y-axis direction) longer than the length of a height direction (Z-axis direction) (i.e., it is desirable that the length of the width direction of the drawer be longer than the length of the height direction of the drawer).

As illustrated in FIG. 2, the drawer 3 includes a drawer body 31 and a drawer cover 35 forming an upper surface of the drawer body 31. The drawer cover 35 may include a first drawer cover 35*a* and a second drawer cover 35*b* coupled to the first drawer cover 35*a* at an upper side of the first drawer cover 35*a*.

The drawer body 31 may be provided in a hexahedral shape with an open upper surface. The drawer cover 35 may be provided to close an upper surface of the drawer body 31.

The drawer body 31 is provided at a front surface thereof with a drawer panel 33. The drawer panel 33 may be provided as a means for opening and closing the entrance 21 and, at the same time, as a means for drawing the drawer body 31 from the cabinet 2 or retracting the drawer body 31 into the cabinet.

The drawer panel 33 may include a panel front face 33*a* parallel to a front face of the cabinet 2 (a face provided with the entrance), a first side face 33*c* and a second side face 33*d* extending from both side surfaces of the panel front face 33*a* toward the drawer body 31, and a panel upper face 33*b* extending from an upper end of the panel front face 33*a* toward the drawer body 31 to form an upper face of the drawer panel 33.

The panel upper face 33*b* may be provided with a control panel 331 for controlling operation of the first treatment apparatus 100. The control panel 331 serves to allow a user to input control commands in order to control a means for supplying or discharging water to or from the accommodation unit 4 and 5 (a water supply unit or a drain unit), a means for rotating laundry (a drum driving portion), and a means for supplying steam or hot air to laundry (a moisture supply unit or a hot air supply unit).

In addition, the control panel 331 is provided with an input unit 332 that allows a user to input a control command to the first treatment apparatus and a display unit 333 (a means for displaying operation information of the first treatment apparatus) for checking a control command input through the input unit 332 or notifying the user of an execution process of the control command input by the user. The control panel 331 may be disposed on the panel upper surface 33*b*.

Figure 5:
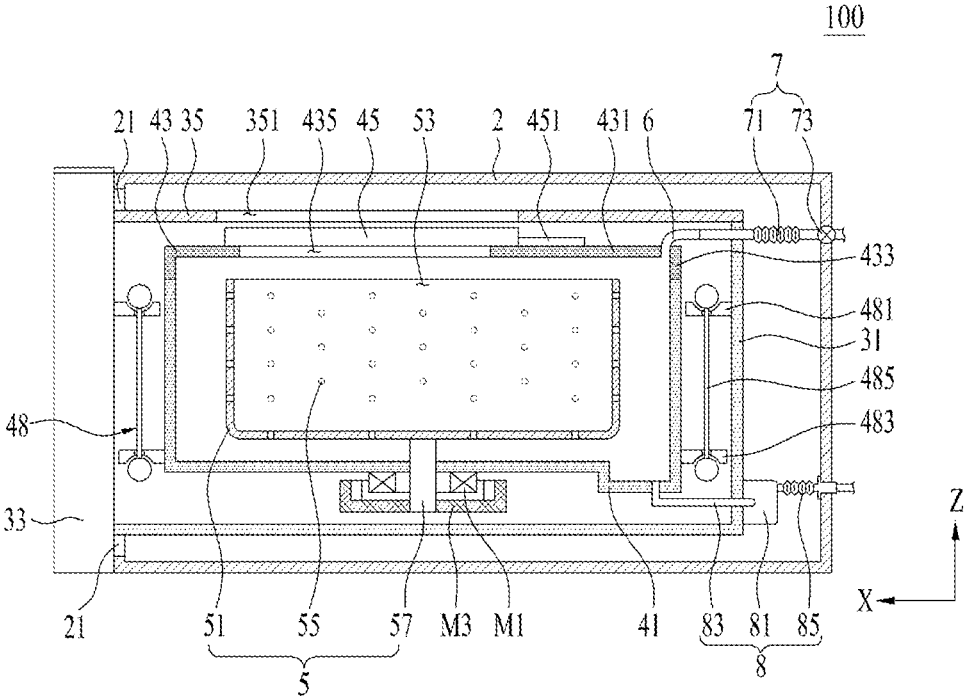
FIGS. 5 to 7 are cross-sectional views of a laundry treatment apparatus including an inflow portion according to an embodiment of the present disclosure.

Referring to FIGS. 2 and 5, the drawer cover 35 may be provided with a drawer introduction port 351 disposed through the drawer cover 35 to communicate the inside of the drawer body 31 with the outside of the drawer body 31 and a penetration unit formed through the drawer cover 35 and connected to a water supply tube 71, which will be described later.

The accommodation unit 4 and 5 provided inside the drawer 3 may include a tub 4 provided inside the drawer body 31 to provide a space for storing washing water and a drum 5 rotatably provided inside the tub 4 to store washing water.

The tub 4 may include a tub body 41 providing a space for storing washing water and having an open upper surface and a tub cover 43 fixed to the upper surface of the tub body 41. The drum 5 may be provided in a cylindrical shape with an open upper surface.

The tub 4 is movably fixed to the inside of the drawer 3 by a tub supporter 48. The tub supporter 48 serves to connect an outer circumferential surface of the tub 4 and the drawer 3 and may include a first bracket 481 provided at the drawer, a second bracket 483 provided at the outer circumferential surface of the tub, and a support bar 485 connecting the first bracket and the second bracket.

The tub 4 is provided at an upper surface thereof with a tub introduction port 435 through which the inside of the tub 4 communicates with the outside of the tub 4, an inflow portion 6 for supplying water to the tub 4, and a door 45 for opening and closing the tub introduction port 453.

The door 45 may be slidably provided at the upper surface of the tub 4 (or the door 45 may be provided to open and close a part of the upper surface of the tub). A user may put laundry into the tub 4 by withdrawing the drawer 3 from the cabinet 2 and then sliding the door 45.

The drum 5 includes a drum body 51 provided in a cylindrical shape and positioned inside the tub 4 and a drum introduction port 53 provided at an upper surface of the drum body 51. Drum through holes 55 are provided at an outer circumferential surface and a bottom surface of the drum body 51, and a driving shaft 57 is provided at the bottom surface of the drum body 51.

The drum body 51 may be rotated inside the tub 4 by a drum driving unit provided outside the tub 4. The drum driving unit may be provided with a stator M1 fixed to the tub 4 to form a rotating magnetic field and a rotor M3 rotated by the rotating magnetic field. The driving shaft 57 is formed through a bottom surface of the tub 4 and is connected to the rotor M3.

As illustrated in the drawing, the drive shaft 57 may be provided to form a right angle with respect to the tub introduction port 435 (provided to form a right angle with respect to the bottom surface of the drawer body).

The reason why the accommodation unit is provided with the tub 4 and the drum 5 is that the treatment apparatus of the present disclosure may perform a washing function. Accordingly, in order for the first treatment apparatus 100 to perform a laundry drying function as well, a hot air supply unit (not shown) for supplying hot air to the tub 4 may be further provided inside the cabinet 2.

The first treatment apparatus is connected to a water supply source located outside the cabinet 2 through a water supply unit 7. The water supply unit 7 may include a water supply tube 71 for connecting a water supply source (not shown) and the inflow portion 6 and a water supply valve 73 for opening and closing the water supply tube 71 by a control unit.

Water stored in the tub 4 is discharged to the outside of the cabinet 2 through a drain unit 8. The drain unit 8 may be provided with a first drain tube 83 for guiding water inside the tub 4 to the outside of the cabinet 2, a drain pump 81 for discharging water inside the tub 4 to the first drain tube 83

(controlled by the control unit), and a second drain tube 85 for guiding water discharged from the drain pump to the outside of the cabinet 2.

Meanwhile, as described above, in the laundry treatment apparatus according to an embodiment of the present disclosure, the height of the cabinet may be smaller than the width of the cabinet. Specifically, since both the first treatment apparatus 100 and the second treatment apparatus 200 are provided, the height of the cabinet 2 may be smaller than the width of the cabinet 2 in the first treatment apparatus 100 in consideration of the body size of a user. The height of the drawer 3 that is withdrawable from the cabinet 2 may also be smaller than the width of the drawer 3. In addition, the height of the tub 4 provided inside the drawer 3 may be smaller than the width of the tub 4. Furthermore, the height of the drum 5 provided inside the tub 4 may be smaller than the width of the drum 5. This serves to efficiently arrange the components in a limited installation space.

As the height of the tub 4 is smaller than the width of the tub 4, the inflow portion 6 provided to allow water to flow into the tub 4 may be blocked by laundry introduced into the drum 5 during washing.

Accordingly, in the laundry treatment apparatus according to an embodiment of the present disclosure, the inflow portion provided to supply water to the tub may be disposed at an outer side of the drum introduction port to prevent the inflow portion from facing the drum introduction port.

Figure 3:
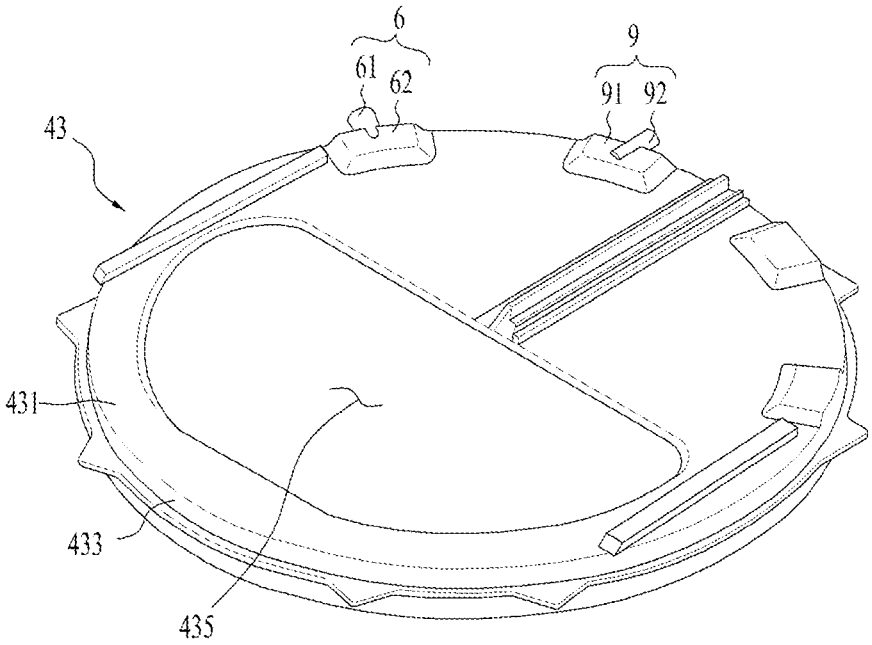
FIG. 3 is a view illustrating a tub cover of a laundry treatment apparatus according to an embodiment of the present disclosure.
Figure 4A:
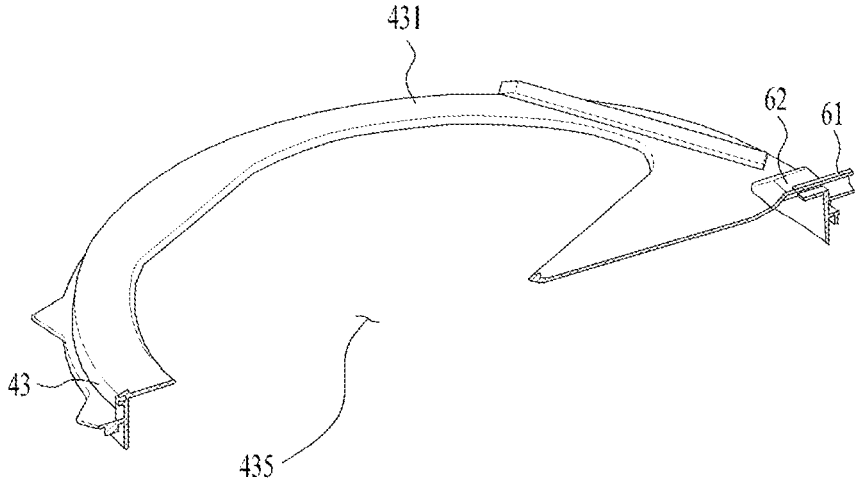
FIGS. 4A and 4B are views illustrating an inflow portion provided at a tub cover of a laundry treatment apparatus according to an embodiment of the present disclosure.
Figure 4B:
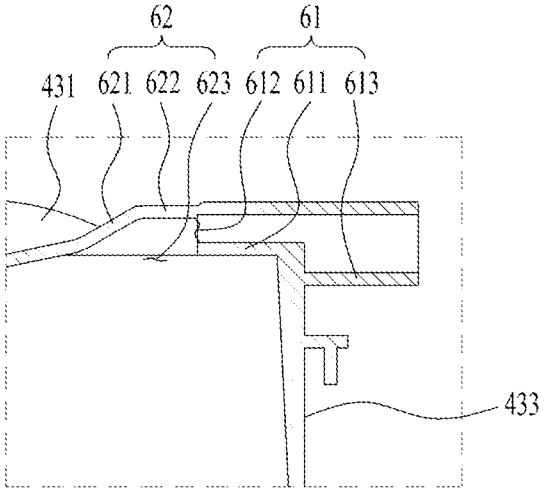

FIG. 3 is a view illustrating a tub cover of a laundry treatment apparatus according to an embodiment of the present disclosure. FIGS. 4A and 4B are views illustrating an inflow portion provided at a tub cover of a laundry treatment apparatus according to an embodiment of the present disclosure.

Figure 6:
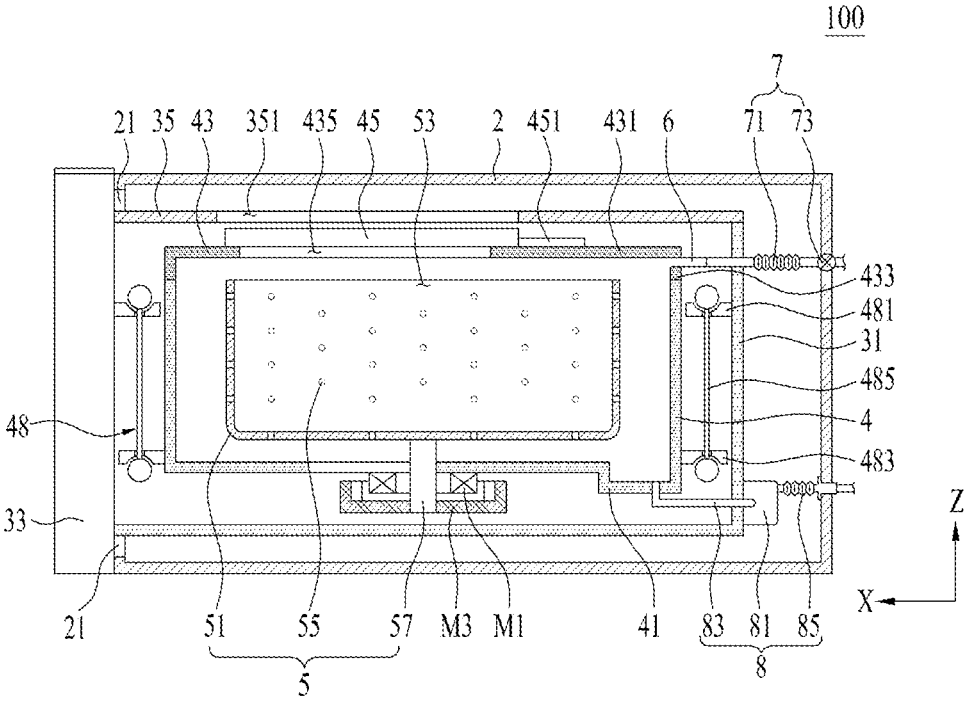
Figure 7:
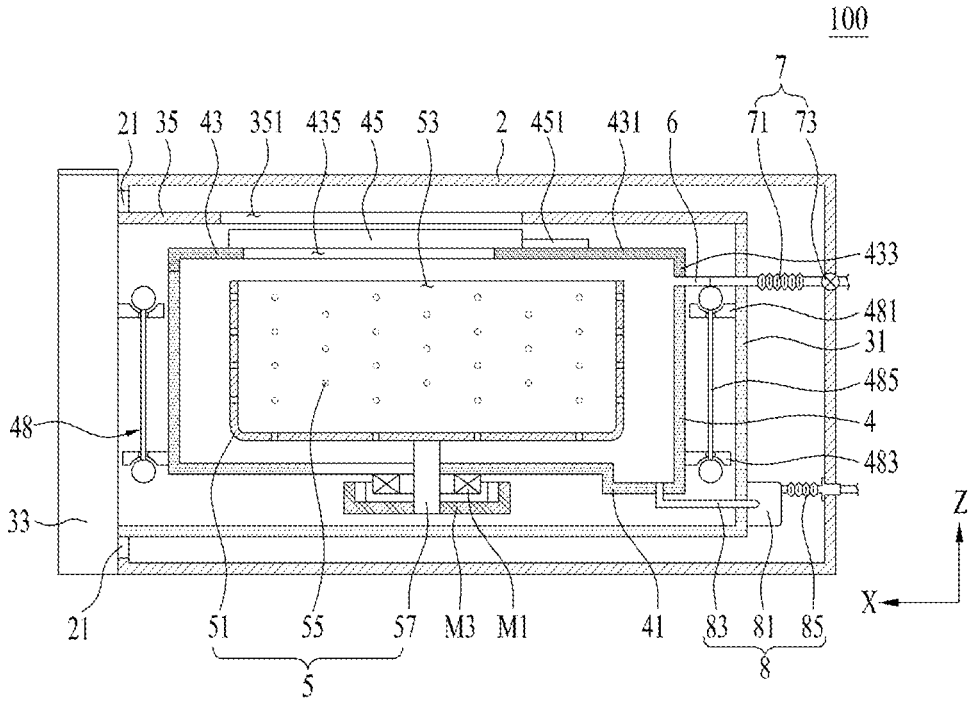

FIGS. 5 to 7 are cross-sectional views of a laundry treatment apparatus including an inflow portion according to an embodiment of the present disclosure. Specifically, FIG. 4A is a cross-sectional view illustrating the inflow portion of a tub cover, and FIG. 4B is an enlarged cross-section of the inflow of the tub cover. FIG. 5 illustrates that the inflow portion is provided at an upper surface of the tub cover. FIG. 6 is a cross-sectional view illustrating that the inflow portion is provided at a side surface of the tub cover. FIG. 7 is a cross-sectional view illustrating that the inflow portion is provided at a tub body. In FIGS. 5 to 7, the side surface of the tub cover, the upper surface of the tub cover, and the tub body are emphasized in order to clarify a position at which the inflow portion is disposed.

A laundry treatment apparatus according to an embodiment of the present disclosure will be briefly described again with reference to FIGS. 3 to 7. This is to clearly describe the laundry treatment apparatus according to an embodiment of the present disclosure. Accordingly, a construction and a description not given below should not be excluded or not be limitedly interpreted.

The laundry treatment apparatus may include the cabinet 2 provided at a front side thereof with the entrance 21. The laundry treatment apparatus may include the drawer 3 that is withdrawable from and retractable into the cabinet 2 through the entrance 21. The laundry treatment apparatus may include the tub 4 provided inside the drawer 3 to provide a space for storing water. The height of the tub 4 may be smaller than the width of the tub 4. The laundry treatment apparatus may include the water supply unit 7 communicating with the tub 4 to supply water. That is, the water supply unit 7 may receive water from a water supply source located outside the cabinet 2 and guide water to the tub 4.

In addition, the laundry treatment apparatus may include the drum 5 including the drum body 51 rotatably provided inside the tub 4 and the drum introduction port 53 that is provided at an upper portion of the drum body 51 and is open to introduce laundry.

The tub 4 may include the tub body 41 in which the drum body 51 is accommodated. The tub 4 may include the tub cover 43 coupled to the upper surface of the tub body 41 to shield the tub body 41. Since the height of the tub 4 is smaller than the width of the tub 4, the tub cover 43 may shield the tub body 41 in order to prevent water from being discharged to the outside. The tub cover 43 may be provided with the tub introduction port 435 so that laundry may be introduced into the drum body 51. That is, the tub introduction port 435 may cause the drum introduction port 53 and the drawer 3 to communicate with each other.

Specifically, the drawer 3 may be provided with the drawer introduction port 351 through which the inside of the drawer 3 and the outside of the drawer 3 communicate with each other. The tub introduction port 435 may cause the drawer introduction port 351 and the drum introduction port 53 to communicate with each other. That is, laundry may be sequentially introduced through the drawer introduction port 351, the tub introduction port 435, and the drum introduction port 53. Accordingly, the drawer introduction port 351, the tub introduction port 435, and the drum introduction port 53 may overlap by a predetermined area or more so that laundry may be easily introduced.

In addition, the tub 4 may include the inflow portion 6 connected to the water supply unit 7 to supply water into the tub 4. That is, water flowing from the water supply source to the water supply unit 7 may flow into the tub 4 through the inflow portion 6.

However, as described above, in order to efficiently utilize an internal space of the drawer 3, the heights of the tub 4 and the drum 5 may be smaller than the widths of the tub 4 and the drum 5. Then, the tub introduction port 435 and the drum introduction port 53 may be provided as close to each other as possible. Accordingly, laundry introduced into the drum 5 through the drum introduction port 53 may contact the tub introduction port 435 and block the inflow portion 6 provided at the tub 4.

Accordingly, the laundry treatment apparatus according to an embodiment of the present disclosure may be provided to prevent the inflow portion 6 from facing the drum introduction port 53.

Specifically, the inflow portion 6 may be provided at either the tub cover 43 or the tub body 41. In addition, the inflow portion 6 may be disposed at an outer side of the drum introduction port 53 to prevent the inflow portion 6 from facing the drum introduction port 53.

Referring to FIGS. 3 to 6, the inflow portion 6 may be provided at the tub cover 43 and may be disposed at the outer side of the drum introduction port 53 so that the inflow portion 6 is prevented from facing the drum introduction port 53.

That is, the inflow portion 6 may be provided to extend from a side surface of the tub cover 43. Alternatively, the inflow portion 6 may be provided to extend from an upper surface of the tub cover 43. That is, the inflow portion 6 may be disposed at any portion of the tub cover 43 so long as the inflow portion 6 is disposed at the outer side of the drum introduction port 53 to prevent the inflow portion from facing the drum introduction port 53.

Specifically, the inflow portion 6 may be provided in the form of a tube that extends from the side surface of the tub cover 43 and is connected to the water supply unit 7.

Alternatively, the inflow portion 6 may be provided in the form of a tube that extends from the upper surface of the tub cover 43 and is connected to the water supply unit 7. Alternatively, the inflow portion 6 may be provided in the form of a tube that extends from both the upper surface of the tub cover 43 and the side surface of the tub cover 43 and is connected to the water supply unit 7. Alternatively, the inflow portion 6 may be provided in the shape of a hole provided by passing through the upper surface of the tub cover 43 or the side surface of the tub cover 43.

That is, the tub cover 43 may include a cover body 431 provided with the tub introduction port 435. The cover body 431 may shield the tub body 41. In addition, the tub cover 43 may include a body coupling portion 433 that extends downward from the cover body 431 and is coupled to the tub body 41. That is, the inflow portion 6 may be provided to extend from the body coupling portion 433. Alternatively, the inflow portion 6 may be provided to extend from the cover body 431. Alternatively, the inflow portion 6 may be provided to extend from both the body coupling portion 433 and the cover body 431. Alternatively, the inflow portion 6 may be provided in the form of a hole provided by passing through either the cover body 431 or the body coupling portion 433.

More specifically, a virtual closed surface (not shown) that extends upwards from an outer circumferential surface of the drum body 51 forming the drum introduction port 53 towards the tub cover 43 and contacts the tub cover 43 may be set. The inflow portion 6 may be provided to be spaced apart from the center of the tub cover 43 in a radial direction of the tub cover 43 rather than in a direction of the virtual closed surface.

More specifically, the tub cover 43 may include the cover body 431 provided with the tub introduction port 435 to shield the tub body 41. The tub cover 43 may also include the body coupling portion 433 that extends downward from the cover body 431 and is coupled to the tub body 41. The inflow portion 6 may be provided at a radial side end of the cover body 431 or at the body coupling portion 433. In addition, the inflow portion 6 may be provided at a portion at which the body coupling portion 433 extends from the cover body 431. Accordingly, the inflow portion 6 may be provided at an outermost side of the tub cover 43.

Then, laundry introduced into the drum 5 may be prevented from accessing the inflow portion 6 by the outer circumferential surface of the drum body 51. That is, access of laundry to the inflow portion 6 may be prevented by the outer circumferential surface of an upper end of the drum body 51. That is, the inflow portion 6 may be prevented as much as possible from being clogged by laundry introduced into the drum 5. Accordingly, water may be smoothly supplied into the tub 4 through the inflow portion 6.

Laundry that is introduced into the drum 5 and then washed may generate bubbles in a washing process or foreign substances may be separated from laundry. While water is supplied to the inside of the tub 4 through the inflow portion 6, bubbles or foreign substances may be prevented from flowing into the inflow portion 6. However, when supply of water through the inflow portion 6 is stopped and washing is performed, bubbles generated by laundry or foreign substances separated from laundry may flow into the inflow portion 6. Foreign substances or bubbles flowing into the inflow portion 6 may deteriorate a sanitary state of the inflow portion 6. Furthermore, foreign substances or bubbles may move up to the water supply unit 7 to deteriorate a sanitary state of the water supply unit 7. As a result, washing water supplied through the water supply unit 7 and the inflow portion 6 for washing may be contaminated. Accordingly, it is desirable that bubbles generated by laundry or foreign substances separated from laundry be prevented from flowing into the inflow portion 6 as much as possible.

The inflow portion 6 is provided with the above-described structure to prevent bubbles generated by laundry or foreign substances separated from laundry from flowing thereinto as much as possible.

On the other hand, the inflow portion 6 is desirably located at a higher side than the drum introduction port 53 as much as possible in order to prevent the inflow portion 6 from being clogged by laundry introduced into the drum 5. The inflow portion 6 may be provided at the tub cover 43 to be located at a higher side than the drum introduction port 53. In this case, as the inflow portion 6 is positioned at a higher side, a phenomenon in which the inflow portion 6 is clogged by laundry may be more efficiently prevented. Increasing the height of the tub cover 43 itself may be one method, but there may be restrictions for space utilization because the height of the tub 4 is smaller than the width of the tub 4. In addition, the tub cover 43 may be provided at an upper portion thereof with the slider 451 provided with the door 45 and the slider will be described later. For this reason, there may be a limit to increasing the height of the tub cover 43 itself.

Accordingly, in the laundry treatment apparatus according to an embodiment of the present disclosure, the inflow portion may be provided at the side surface of the tub cover and may protrude upward.

Referring to FIGS. 3 to 6, the tub cover 43 may include the cover body 431 provided with the tub introduction port 435. The cover body 431 may shield the tub body 41. In addition, the tub cover 43 may include the body coupling portion 433 that extends downward from the cover body 431 and is coupled to the tub body 41. The body coupling portion 433 may include a coupling protrusion to be easily coupled to the tub body 41. The coupling protrusion may extend from an outer circumferential surface of the body coupling portion 433 towards a radial side of the body coupling portion 433.

The inflow portion 6 may include an inflow guide 61 provided by passing through the body coupling portion 433 and is connected to the water supply unit 7. The inflow portion 6 may further include an inflow protrusion 62 protruding from the cover body 431 toward an upper surface of the drawer 3. The inflow protrusion 62 may be provided with an open lower surface in order to supply water into the tub 4. One end of the inflow guide 61 may be located inside the inflow protrusion 62. The inflow guide 61 may be connected to the water supply unit 7. Water may be supplied into the tub 4 through the inflow guide 61.

That is, the inflow protrusion 62 may increase a height at which the inflow guide 61 is provided. Thus, a phenomenon in which the inflow guide 61 is clogged by laundry may be prevented as much as possible.

The inflow protrusion 62 may be provided to protrude while having a cross-sectional area of a predetermined area or more. The inflow guide 61 may be provided in the center of the inflow protrusion 62.

The cover body 431 may be provided with the slider 451 that is provided with the door 45 and is slidable. The door 45 may be moved away from the slider 451 due to failure or damage. In this case, the inflow portion 6 may be impacted by the door 45 that is adjacent to the slider 451 and deviates from the slider 451. The inflow protrusion 62 protrudes while having a cross-sectional area equal to or greater than a certain area, and the inflow guide 61 is provided in the center of the inflow protrusion 62 so that damage of the inflow guide 61 coupled to the water supply unit 7 may be prevented as much as possible. The inflow guide 61 may be prevented as much as possible by the inflow protrusion 62 from being damaged even by an impact caused by other causes.

The inflow guide 61 may extend from one end positioned inside the inflow protrusion 62 to the other end connected to the water supply unit 7. The inflow guide 61 may be provided at one end thereof with an inflow hole 612 through which the inside of the tub 4 with the water supply 7 communicates with each other. The inflow guide 61 may extend by passing through the body coupling portion 433. The inflow guide 61 may have one end extending from an upper surface of the inflow protrusion 62. That is, the upper surface of the inflow protrusion 62 may extend up to the other end of the inflow guide 61 as one closed surface. Accordingly, the inflow guide 61 may be strongly supported by the upper surface of the inflow protrusion 62 and the body coupling portion 433.

In addition, an uppermost side of the inflow guide 61 may be provided at the cover body 431 to be higher than an uppermost side of the inflow protrusion 62. This serves to make the height of the inflow guide 61 to which water is supplied as large as possible.

The cross section of the inflow hole 612 may be provided to face the cross section of the entrance 21. That is, the cross section of the inflow hole 612 may be perpendicular to the cross section of the drum introduction port 53. Accordingly, inflow of foreign substances or bubbles into the inflow hole 612 may be prevented as much as possible compared to the case in which the cross section of the inflow hole 612 is provided in parallel with the cross section of the drum introduction port 53.

If the cross section of the inflow hole 612 is provided to face the cross section of the entrance 21, when water is supplied from the water supply unit 7 to the inside of the tub 4, a water flow may be strongly formed in a front direction by water pressure. For this reason, the water flow may strongly hit the inflow protrusion 62, a large amount of water may be scattered, and resistance may be generated against the supplied water flow.

Accordingly, it may be desirable that an internal space of the inflow protrusion 62 be sufficiently secured. That is, one end of the inflow guide 61 may be provided to be spaced apart from the inner side surface of the inflow protrusion 62. Then, the resistance of the water flow supplied to the inside of the tub 4 through the inflow guide 61 may be reduced.

The inflow protrusion 62 may be provided to be inclined in a radial direction of the cover body 431. That is, the inflow protrusion 62 may be provided to extend from an inner end to an outer end and an upward protrusion length may be more increased at the outer end rather than at the inner end. Alternatively, the inflow protrusion 62 may be provided to extend from the inner end to the outer end, and the upward protrusion length may be more increased at the outer end rather than at the inner end and may be constant from a certain point. That is, the inflow protrusion 62 may include an inflow protrusion inclined portion 621 provided to be inclined in a radial direction of the cover body 431. The inflow protrusion 62 may also include an inflow protrusion extension 622 extending from the inflow protrusion inclined portion 621 to the inflow guide 61.

Thereby, the inflow protrusion 62 causes water supplied into the tub 4 through the inflow hole 612 to be supplied with reduced resistance of a water flow along an inner circumferential surface of the inflow protrusion 62.

Meanwhile, the inflow portion 6 needs to receive strong support and secure a sufficient movement cross-sectional area of water. Accordingly, the diameter of each part of the inflow portion 6 may be differently provided.

Specifically, the water supply unit 7 may include a water supply valve 73 provided to selectively receive water from the water supply source. The water supply unit 7 may also include a water supply tube 71 connected to the water supply valve 73 and up to the inflow portion 6. The water supply tube 71 may be provided as a corrugated tube to prevent the water supply tube 71 from being damaged when the drawer 3 is withdrawn. More specifically, the inflow guide 61 may be connected to the water supply tube 71. A method in which the water supply tube 71 and the inflow guide 61 are connected may be provided in various ways. For example, the water supply tube 71 may be provided to be inserted into the inflow guide 61 or may be provided to be connected to the inflow guide 61 by a separate member. In addition, the inflow guide 61 may be provided to be inserted into the water supply tube 71.

The inflow guide 61 may include a first inflow guide 611 extending from one end of the inflow guide 61 and passing through the body coupling portion 433. The inflow guide 61 may also include a second inflow guide 613 extending from the first inflow guide 611 to an outer side of the body coupling portion 433. The second inflow guide 613 may be connected to the water supply tube 71. That is, the first inflow guide 611 may be a portion of the inflow guide 61, that extends by passing through the body coupling portion 433 from one end of the inflow protrusion 62 of the inflow guide 61 to an outer circumferential surface of the body coupling portion 433. In addition, the second inflow guide 613 may be a portion of the inflow guide 61, that is connected to the water supply tube 71 at the outer circumferential surface of the body coupling portion 433. A diameter of the second inflow guide 613 may be larger than a diameter of the first inflow guide 611.

In order to sufficiently secure the movement area of water guided into the tub 4, when the diameter of the inflow guide 61 is increased in a constant state, the inflow guide 61 may not receive sufficient support force because an area which is not supported by the body coupling portion 433, the inflow protrusion 62, and the cover body 431 is increased as compared to an area supported thereby. In this case, the possibility of damage of the inflow guide 61 may be increased.

Accordingly, the movement area of water guided into the tub 4 may be secured and sufficient support force may also be secured by providing the diameter of the second inflow guide 613 larger than the diameter of the first inflow guide 611.

As described above, when the height of the tub 4 is limited, the installed height of the inflow portion 6 may also be limited. Accordingly, the highest height of the first inflow guide 611 from a lower surface of the tub 4 may be the same as the highest height of the second inflow guide 613 from the lower surface of the tub 4. In addition, a lower end of the second inflow guide 613 may be disposed below a lower end of the first inflow guide 611 to extend from the body coupling portion 433.

That is, an upper end of the first inflow guide 611 may form one continuous surface with an upper end of the second inflow guide 613, and the lower end of the first inflow guide 611 may not form one continuous surface with the lower end of the second inflow guide 613. As the second inflow guide 613 has a large diameter, an area in contact with an outer circumferential surface of the body coupling portion 433 is increased to receive large supporting force. As a result, the inflow guide 61 may sufficiently secure a flow area of water supplied into the tub 4 while minimizing a length provided to protrude towards an upper surface of the drawer 3. In addition, the inflow guide 61 may be provided with sufficient support force by the outer circumferential surface of the body coupling portion 433.

On the other hand, since the laundry treatment apparatus according to an embodiment of the present disclosure is provided in a pull-out type by the drawer 3, the drawer introduction port 351 and the tub introduction port 435 may be provided to incline towards a front side at which the entrance 21 is disposed. Then, an area in which components are installed at the front side of the drawer body 31 may not be sufficient. In addition, the components provided at the front side of the drawer body 31 may be exposed to the outside.

Accordingly, in the laundry treatment apparatus according to an embodiment of the present disclosure, the inflow portion may be disposed to be spaced apart from the tub introduction port in a rear direction. Thus, the water supply unit 7 may be prevented from being exposed to the outside when the drawer 3 is withdrawn.

Specifically, the water supply valve 73 may be located at a rear side of the laundry treatment apparatus so as to prevent exposure to the outside when the laundry treatment apparatus is installed. The water supply tube 71 connecting the water supply valve 73 and the inflow portion 6 may have one end connected to the water supply valve 73 and the other end connected to the inflow portion 6. Accordingly, if the inflow portion 6 is provided at a front side of the tub body 4, the length of the water supply tube 71 may be increased. In addition, the water supply tube 71 may contact other components between the inflow portion 6 and the water supply valve 73. To prevent this, the inflow portion 6 may be provided to be spaced apart from the tub introduction port 435 in a rear direction. Thus, the laundry treatment apparatus may be aesthetically excellent and may efficiently use an inner space of the cabinet 2 and an inner space of the drawer 3.

The door 45 for opening and closing the tub introduction port 435 may be provided in a sliding type. Referring to FIGS. 2 to 6, the door 45 may reciprocate forward and backward along the slider 451 provided at the tub introduction port 435. That is, a user may open the tub introduction port 435 by withdrawing the drawer 3 and then sliding the door 45 in a rear direction. The user may then put laundry into the drum 5. As described above, the tub introduction port 435 may be provided at a front side towards which the drawer 3 is withdrawn in order for the user to put laundry into the drum 5. The door 45 for opening and closing the tub introduction port 435 may be provided to reciprocate forward and backward from the front side due to the position of the tub introduction port 435. Accordingly, the slider 451 for allowing the door 45 to reciprocate may be provided to extend from the front side to the rear side of the cover body 431.

Due to the above-described structure, the inflow portion 6 may be desirably provided to be spaced apart from the tub introduction port 435 in a rear direction. The inflow portion 6 may be provided to be spaced apart from the tub introduction port 435 in a rear direction by comprehensively considering the position of the water supply unit 7 and the position of the slider 451.

Meanwhile, referring to FIG. 7, the inflow portion 6 may be provided at the tub body 41. If the inflow portion 6 is provided at the tub body 41, since the drum 5 is accommodated in the tub body 41, the inflow portion 6 may be prevented from facing the drum introduction port 53. Then, the inflow portion 6 may be prevented as much as possible from being clogged by laundry introduced into the drum 5.

However, if the inflow portion 6 is provided at the tub body 41, the height of the inflow portion 6 from the lower surface of the tub 4 may be desirably greater than the highest water level of the tub body 41. That is, if the inflow portion 6 is provided to be smaller than the highest water level of the tub body 41, water may flow backward through the inflow portion 6 during washing, and foreign substances separated from laundry may be introduced.

In addition, if the inflow portion 6 is provided at the tub body 41, a water flow generated by the rotation of the drum 5 may rise. Then, water may flow backward through the inflow portion 6, and foreign substances separated from laundry may be introduced. Accordingly, the inflow portion 6 may be desirably provided at the uppermost end of the tub body 41.

Furthermore, since the tub body 41 is coupled to the body coupling portion 433, the inflow portion 6 may be provided at a portion at which the tub body 41 and the body coupling portion 433 are connected. In this case, the inflow portion 6 may be provided with strong supporting force and may be disposed at the uppermost side from the lower surface of the tub body 41.

The water supply valve 73 may be located at a rear side of the laundry treatment apparatus so as to prevent exposure to the outside when the laundry treatment apparatus is installed. The water supply tube 71 connecting the water supply valve 73 and the inflow portion 6 may have one end connected to the water supply valve 73 and the other end connected to the inflow portion 6. Accordingly, if the inflow portion 6 is provided at the front side of the tub body 41, the length of the water supply tube 71 may be increased. In addition, the water supply tube 71 may contact other components between the inflow portion 6 and the water supply valve 73. To prevent this, the inflow portion 6 may be provided to be spaced apart from the tub introduction port 435 in a rear direction. That is, the inflow portion 6 may be provided at the rear side of the tub body 41. Accordingly, the laundry treatment apparatus may be aesthetically excellent and may efficiently use the inner space of the cabinet 2 and the inner space of the drawer 3.

In addition, as described above, the door 45 may reciprocate forward and backward along the slider 451 provided at the tub introduction port 435. That is, a user may open the tub introduction port 435 by withdrawing the drawer 3 and then sliding the door 45 in a rear direction. The user may then put laundry into the drum 5. Thus, if the inflow portion 6 is provided at the tub body 41, interference with the slider 451 may be prevented.

Meanwhile, the laundry treatment apparatus according to an embodiment of the present disclosure may further include a balancer to reduce vibration generated when the drum rotates.

Figure 8:
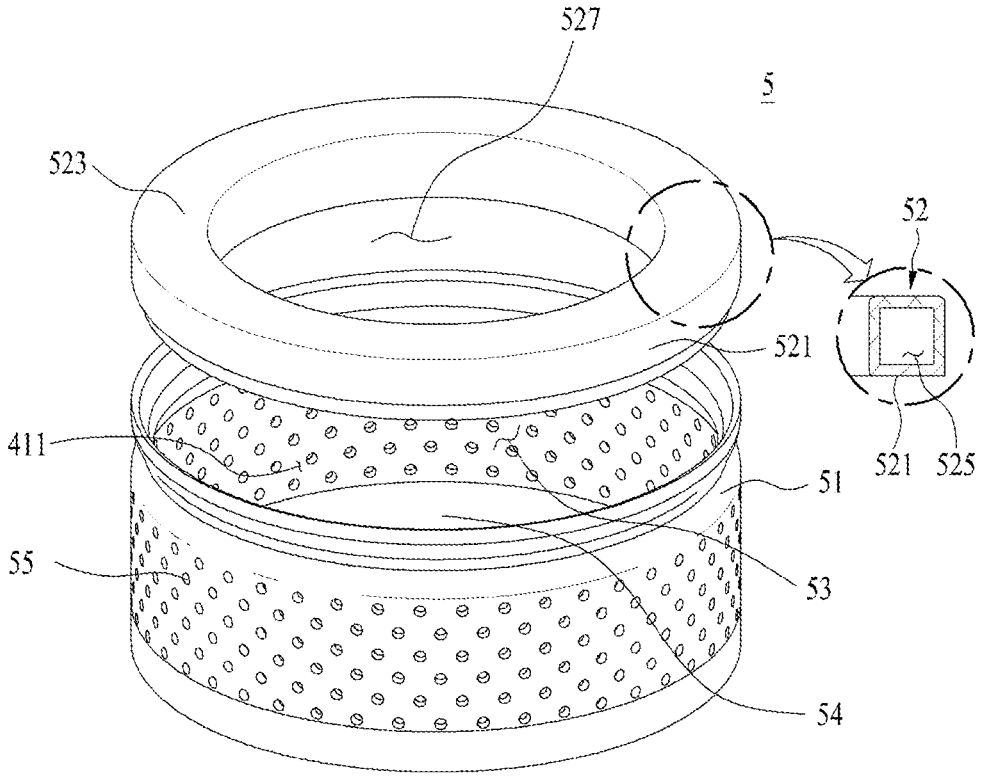
FIG. 8 is a view illustrating a balancer according to an embodiment of the present disclosure.

Referring to FIG. 8, a balancer 52 may be provided at an upper side of the drum. Specifically, the balancer 52 may be provided at the upper side of the drum body 51, that is, a portion at which the drum introduction port 53 is formed. The balancer 52 may be operated to attenuate vibration that occurs when the drum 40 rotates.

The balancer 52 may include a balancer housing 521 and a balancer cover 523. The balancer housing 521 may be fixed to the drum body 51 to form an upper surface of the drum body 51.

The balancer 52 may be provided with an open upper surface. That is, the balancer housing 521 may be provided in a ring shape so that a balancer through hole 527 passing through the balancer housing 521 is provided. In other words, the open upper surface of the balancer 52 may mean the balancer through hole 527.

In addition, the balancer 52 includes a circulation passage 525 provided in a ring shape to provide a movement path of liquid and includes liquid stored in the circulation passage 525. In this case, the type of liquid is not limited so long as the liquid is accommodated in the balancer housing 521 and flows in order to solve imbalance according to the rotation of the drum 40.

Since the balancer through hole 527 is located under the tub introduction port 435, laundry introduced through the tub introduction port 435 moves into the drum body 51 through the balancer through hole 527. Accordingly, the balancer through hole 527 communicates with the drum introduction port, and laundry passing through the balancer through hole 527 is introduced into the drum body 51 through the drum introduction port.

An upper end of the balancer housing 521 and a lower end of the balancer cover 523 may be coupled through thermal fusion. That is, the balancer housing 521 and the balancer cover 523 are integrally provided through thermal fusion to determine an outer appearance of the balancer 52. That is, as illustrated in FIG. 8, it is desirable that the balancer housing 521 and the balancer cover 523 be integrally formed.

A lower end of the balancer housing 521 may be inserted into the drum body 51, and the upper side of the balancer housing 521 may be exposed to the outside of the drum body 51.

That is, if the balancer 52 is provided at an upper portion of the drum 5, the balancer through hole 527 may communicate with the drum introduction port 53 to serve the same role as the drum introduction port 53, and the balancer housing 521 may be connected to the drum body 51 to serve the same role as the drum body 51.

Figure 9:
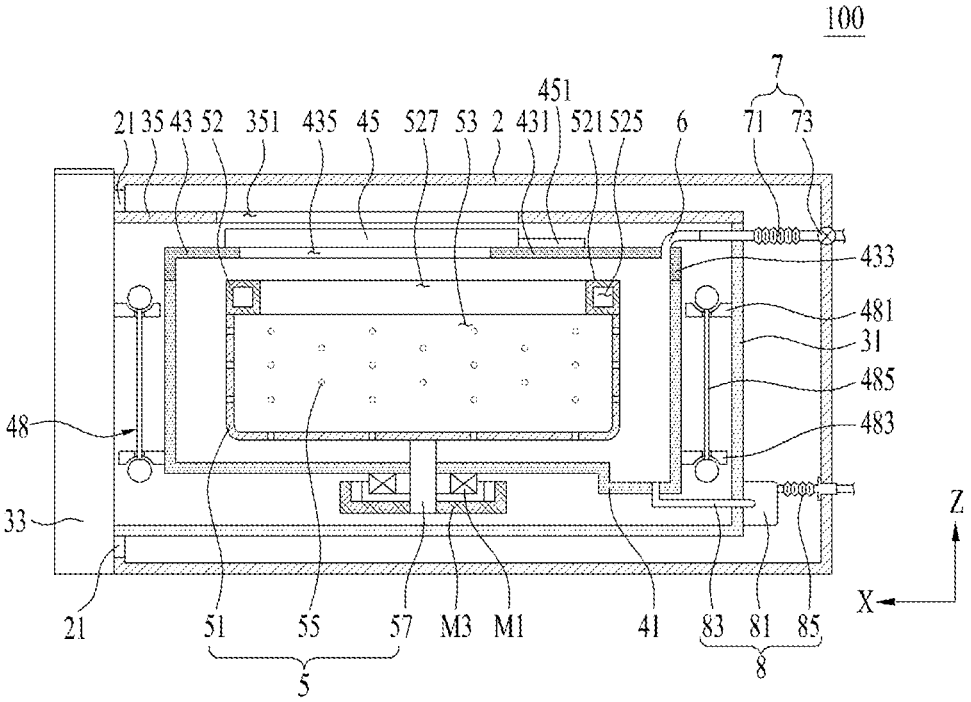
FIGS. 9 and 10 are cross-sectional views of a laundry treatment apparatus including a balancer and an inflow portion according to an embodiment of the present disclosure.
Figure 10:
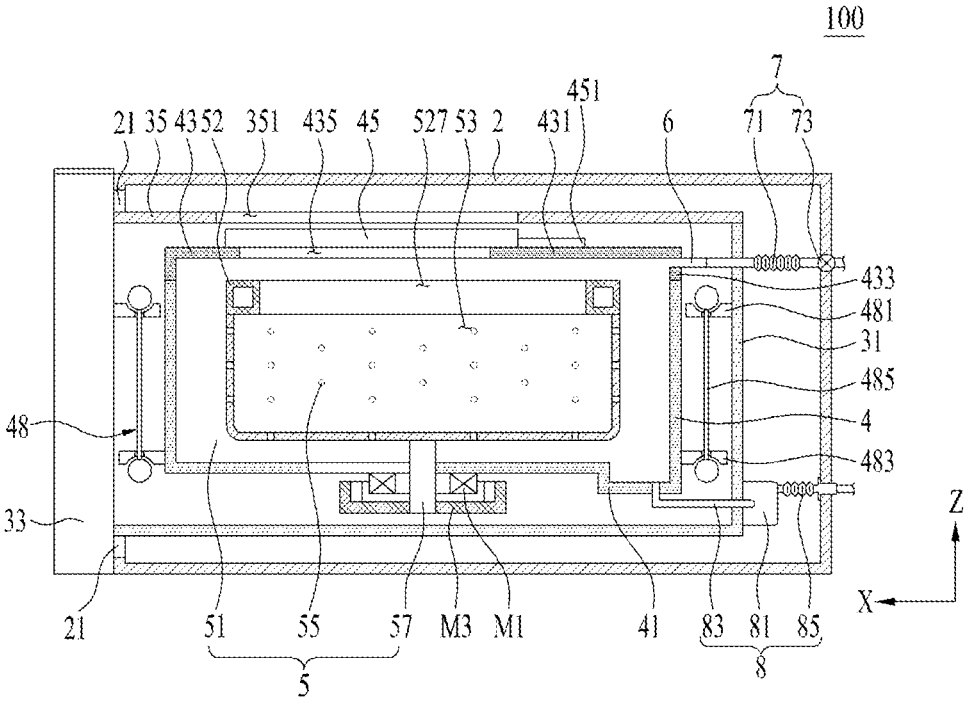

Accordingly, in the laundry treatment apparatus according to an embodiment of the present disclosure, the inflow portion may be disposed outside an upper surface of the balancer. FIGS. 9 and 10 are cross-sectional views of a laundry treatment apparatus including a balancer and an inflow portion according to an embodiment of the present disclosure. FIG. 9 illustrates that the inflow portion is provided at an upper surface of a tub cover, and FIG. 10 illustrates that the inflow portion provided at a side surface of the tub cover. In FIGS. 9 and 10, the side surface of the tub cover and the upper surface of the tub cover are illustrated by emphasizing a position relationship therebetween.

Referring to FIGS. 8 to 10, the inflow portion 6 may be provided at the tub cover 43 and may be disposed outside the upper surface of the balancer 52 to prevent the inflow portion 6 from facing the upper surface of the balancer 52.

Thereby, laundry introduced into the drum 5 may be prevented from accessing the inflow portion 6 by an outer circumferential surface of the balancer housing 521. That is, access of laundry to the inflow portion 6 may be prevented by an outer circumferential surface of an upper end of the balancer housing 521. In other words, the inflow portion 6 may be prevented as much as possible from being clogged by laundry introduced into the drum 5. Accordingly, water may be smoothly supplied into the tub 4 through the inflow portion 6.

Laundry that is introduced into the drum 5 and then washed may generate bubbles in a washing process or foreign substances may be separated from laundry. While water is supplied to the inside of the tub 4 through the inflow portion 6, bubbles or foreign substances may be prevented from flowing into the inflow portion 6. However, when supply of water through the inflow portion 6 is stopped and washing is performed, bubbles generated by laundry or foreign substances separated from laundry may flow into the inflow portion 6. Foreign substances or bubbles flowing into the inflow portion 6 may deteriorate a sanitary state of the inflow portion 6. Furthermore, foreign substances or bubbles may move up to the water supply unit 7 to deteriorate a sanitary state of the water supply unit 7. As a result, washing water supplied through the water supply unit 7 and the inflow portion 6 for washing may be contaminated. Accordingly, it is desirable that bubbles generated by laundry or foreign substances separated from laundry be prevented from flowing into the inflow portion 6.

The inflow portion 6 is provided with the above-described structure to prevent bubbles generated by laundry or foreign substances separated from laundry from flowing thereinto as much as possible.

Meanwhile, as illustrated in FIG. 7, the inflow portion 6 may be provided at the tub body 41. If the inflow portion 6 is provided at the tub body 41, since the balancer 52 is accommodated inside the tub body 41, the inflow portion 6 may be prevented from facing the balancer through hole 527. Accordingly, a phenomenon in which laundry blocks the inflow portion 6 may be prevented as much as possible by the balancer housing 521.

On the other hand, when the laundry treatment apparatus is sealed, there may be a pressure difference between the inside and the outside of the laundry treatment apparatus. That is, the temperature of the laundry treatment apparatus may be increased when hot water is used or a drying function is used or may be decreased when cold water is used. The pressure difference between the inside and the outside of the laundry treatment apparatus may change the shape of the laundry treatment apparatus or, in severe cases, may cause damage. In addition, there may be a problem that the door is not opened after a washing process is completed. Accordingly, the laundry treatment apparatus may include a communication portion through which the inside of the tub and the outside of the cabinet communicate with each other. However, the communication portion may be blocked by laundry introduced into the drawer, and foreign substances may be introduced into the communication portion.

Accordingly, in the laundry treatment apparatus according to an embodiment of the present disclosure, a communication connection portion may be provided at an outer side of the drum introduction port. Hereinafter, a description will be given with reference to FIGS. 4A and 4B and FIGS. 11A to 14. A description overlapping with the above-described contents is omitted. However, the omitted contents should not be excluded or may not be limitedly interpreted.

Figure 11A:
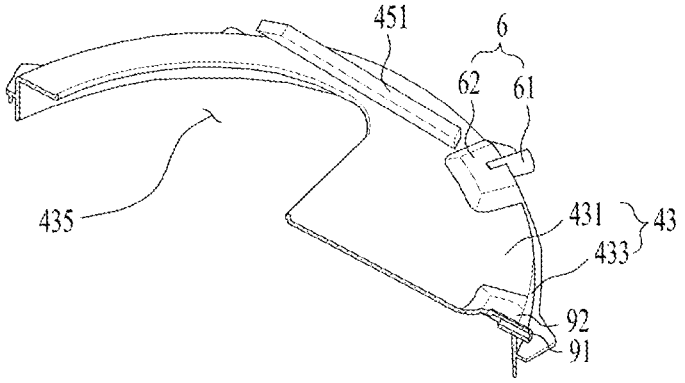
FIGS. 11A and 11B are views illustrating a communication connection portion of a laundry treatment apparatus according to an embodiment of the present disclosure.
Figure 11B:
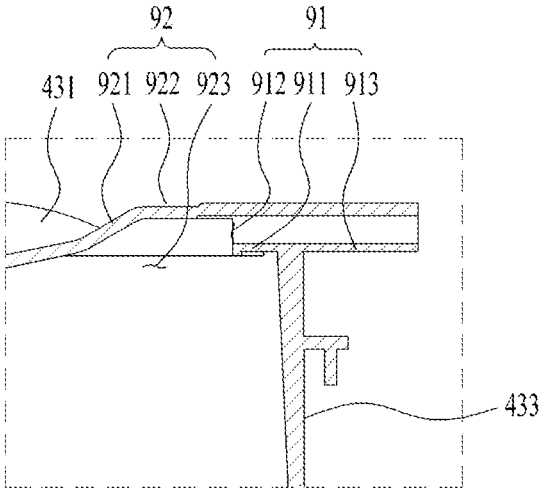
Figure 12:
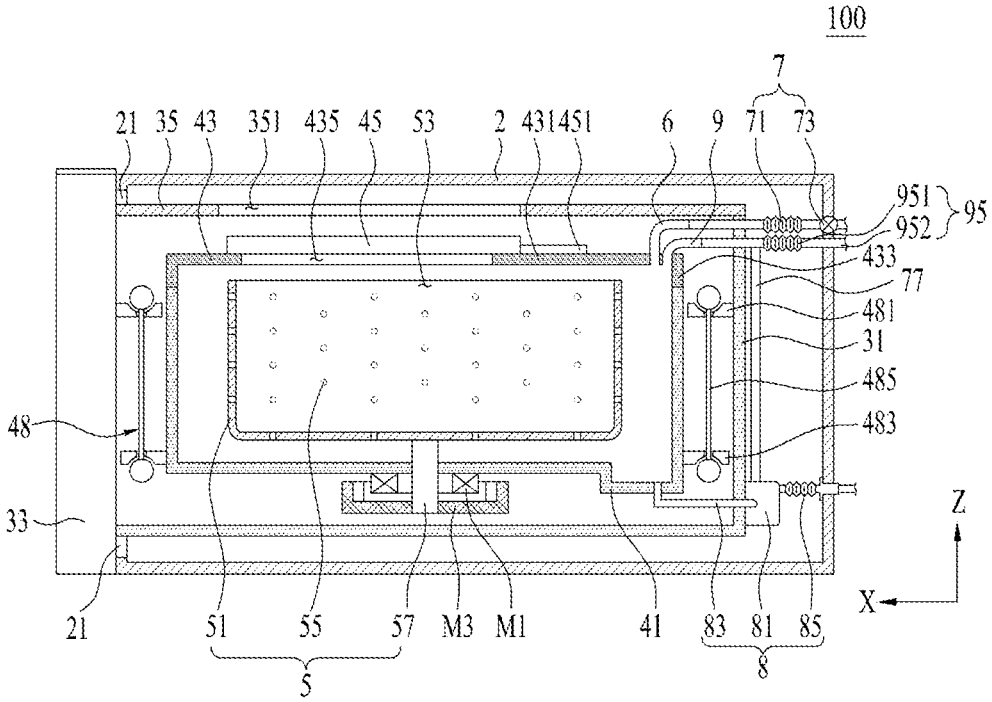
FIGS. 12 to 14 are cross-sectional views of a laundry treatment apparatus including a communication connection portion according to an embodiment of the present disclosure.
Figure 13:
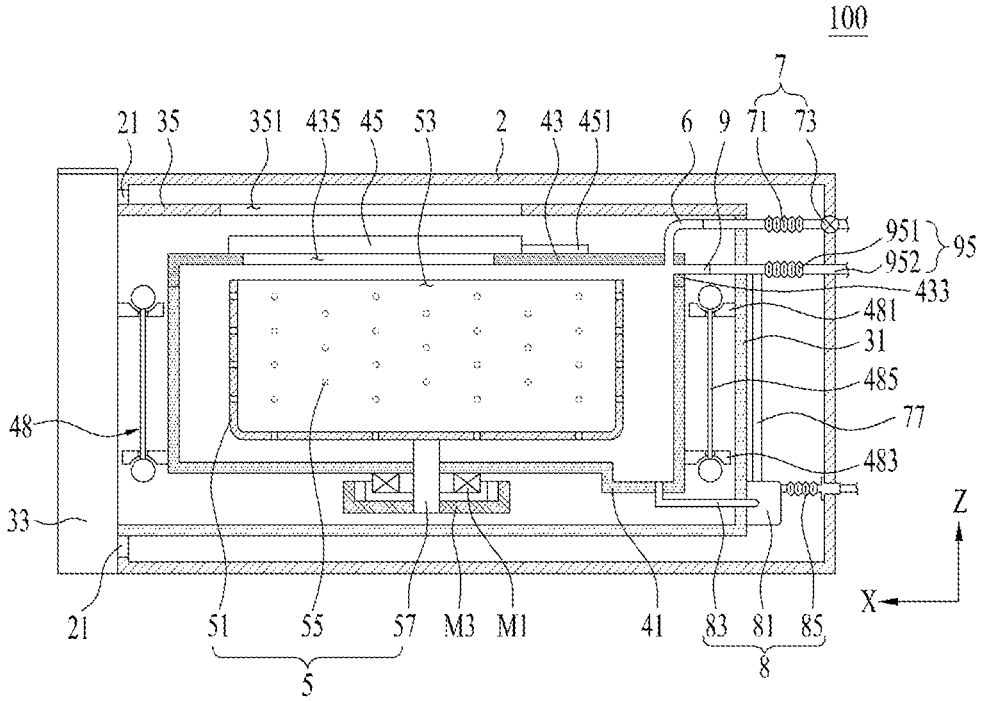
Figure 14:
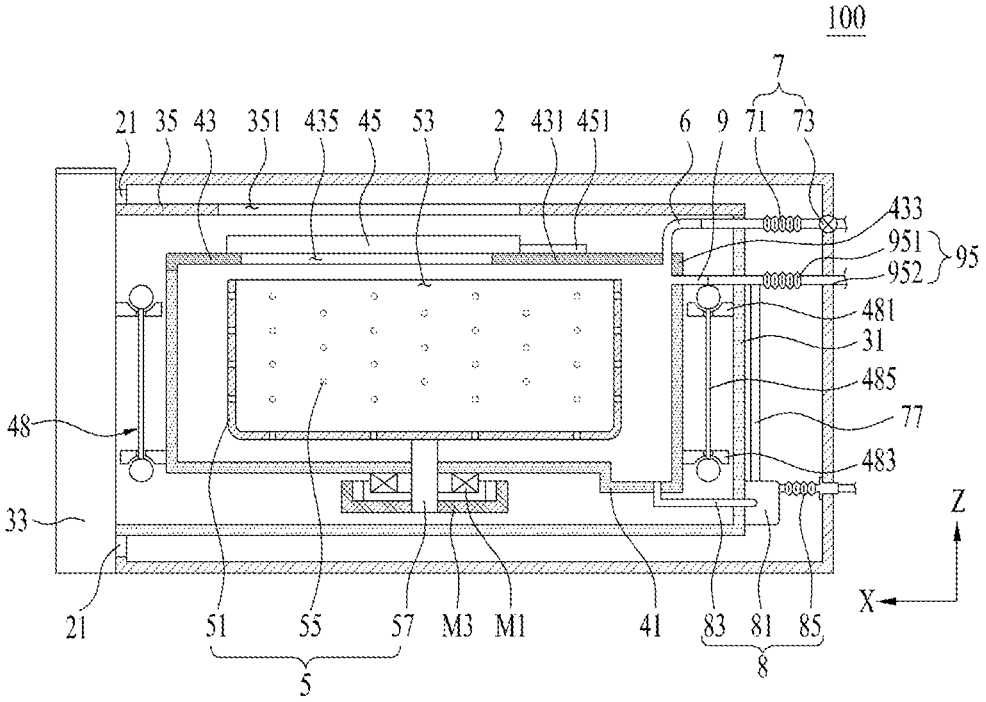
Figure 15:
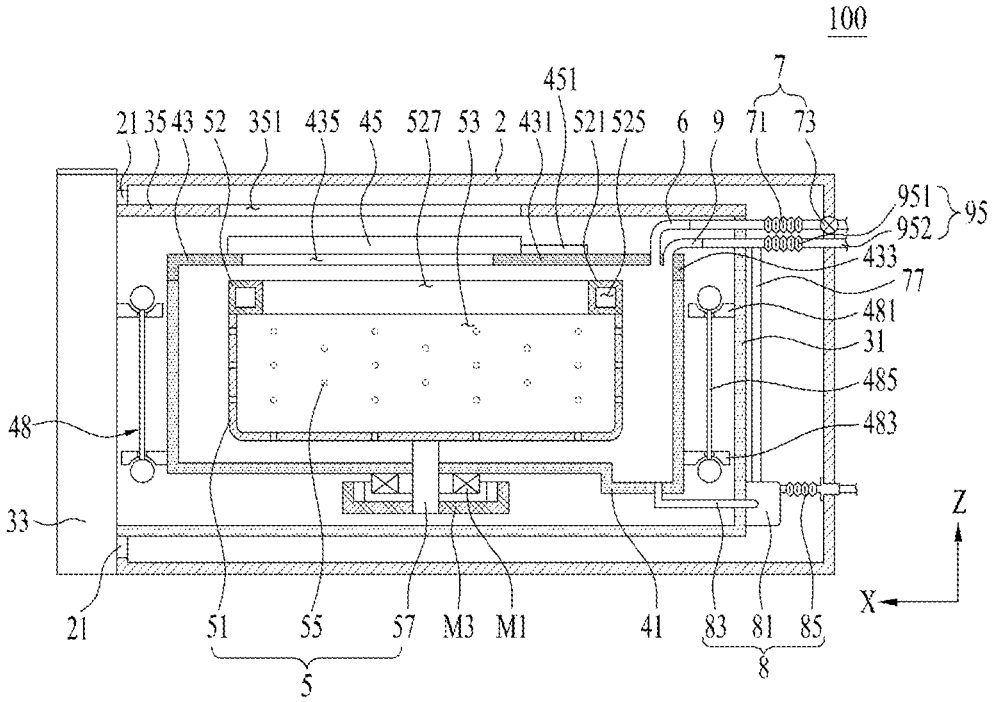
FIGS. 15 and 16 are cross-sectional views of a laundry treatment apparatus including a balancer and a communication connection portion according to an embodiment of the present disclosure.
Figure 16:
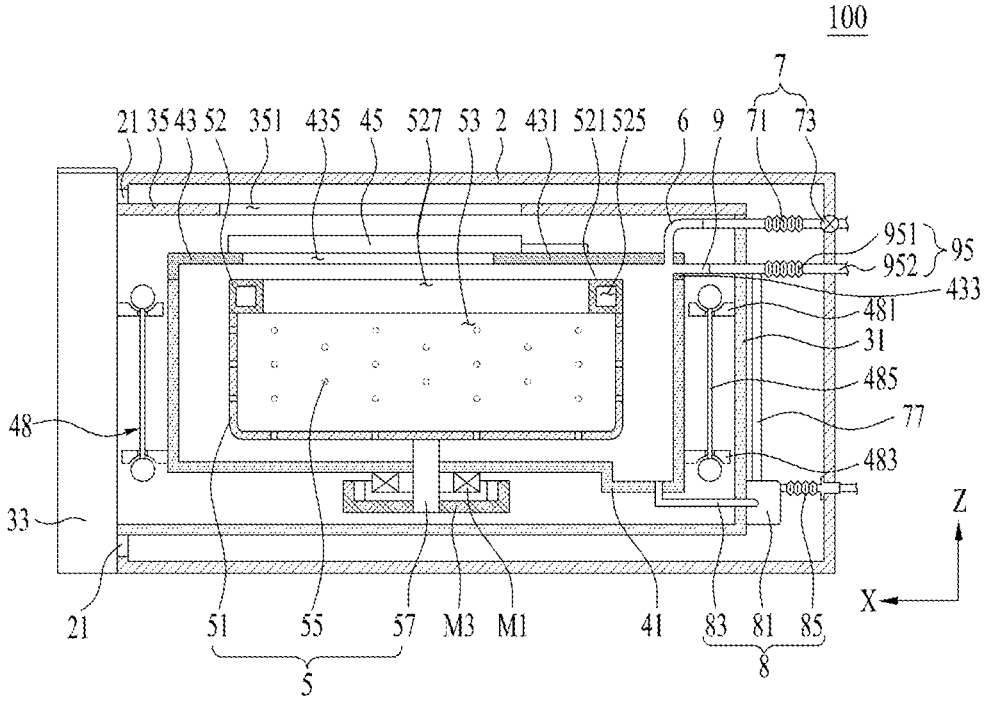

FIGS. 11A and 11B are views illustrating a communication connection portion of a laundry treatment apparatus according to an embodiment of the present disclosure. That is, FIGS. 11A and 11B are cross sectional views of the communication connection portion. FIGS. 12 to 14 are cross-sectional views of a laundry treatment apparatus including a communication connection portion according to an embodiment of the present disclosure. FIGS. 15 and 16 are cross-sectional views of a laundry treatment apparatus including a balancer and a communication connection portion according to an embodiment of the present disclosure. FIG. 11A is a cross-sectional view illustrating the communication connection portion of a tub cover, and FIG. 11B is an enlarged cross sectional view of the communication connection portion of the tub cover.

Specifically, FIGS. 12 and 15 illustrate that the communication connection portion is disposed at the upper surface of the tub cover, and FIGS. 13 and 16 illustrate that the communication connection portion is provided at the side surface of the tub cover. FIG. 14 illustrates that the communication connection portion is provided at the tub body. In FIGS. 12 to 16, the side surface of the tub cover, the upper surface of the tub cover, and the tub body are illustrated by emphasizing a position relationship therebetween.

Specifically, referring to FIGS. 3 and 11A to 14, the laundry treatment apparatus according to an embodiment of the present disclosure may include a communication portion through which the outside of the cabinet and the tub communicate with each other. In addition, the laundry treatment apparatus may further include a communication connection portion for connecting the communication portion and the inside of the tub.

The communication connection portion 9 may be provided at the tub body 41 or the tub cover 43. In addition, the communication connection portion 9 may be disposed at an outer side of the drum introduction port 53 to prevent the communication connection portion 9 from facing the drum introduction port 53.

The communication connection portion 9 may be provided at the tub cover 43 and may be disposed at the outer side of the drum introduction port 53 to prevent the communication connection portion 9 from facing the drum introduction port 53.

That is, the communication connection portion 9 may be provided to extend from a side surface of the tub cover 43. Alternatively, the communication connection portion 9 may be provided to extend from an upper surface of the tub cover 43. That is, the communication connection portion 9 may be provided at any portion of the tub cover 43 so long as the communication connection portion 9 is disposed at the outer side of the drum introduction port 53 to prevent the communication connection portion 9 from facing the drum introduction port 53.

Specifically, the communication connection portion 9 may be provided in the form of a tube that extends from the side surface of the tub cover 43 and is connected to the communication portion 95. Alternatively, the communication connection portion 9 may be provided in the form of a tube that extends from the upper surface of the tub cover 43 and is connected to the communication portion 95. Alternatively, the communication connection portion 9 may be provided in the form of a tube that extends from both the upper surface of the tub cover 43 and the side surface of the tub cover 43 and is connected to the communication portion 95. Alternatively, the communication connection portion 9 may be provided in the shape of a hole provided by passing through the upper surface of the tub cover 43 or the side surface of the tub cover 43.

That is, the tub cover 43 may include the cover body 431 provided with the tub introduction port 435. The cover body 431 may shield the tub body 41. In addition, the tub cover 43 may include the body coupling portion 433 that extends downward from the cover body 431 and is coupled to the tub body 41. That is, the communication connection portion 9 may be provided to extend from the body coupling portion 433. Alternatively, the communication connection portion 9 may be provided to extend from the cover body 431. Alternatively, the communication connection portion 9 may be provided to extend from both the body coupling portion 433 and the cover body 431. Alternatively, the communication connection portion 9 may be provided in the form of a hole provided by passing through either the cover body 431 or the body coupling portion 433.

Specifically, a virtual closed surface (not shown) that extends upwards from the outer circumferential surface of the drum body 51 forming the drum introduction port 53 towards the tub cover 43 and contacts the tub cover 43 may be set. The communication connection portion 9 may be provided to be spaced apart from the center of the tub cover 43 in a radial direction of the tub cover 43 rather than in a direction of the virtual closed surface.

More specifically, the tub cover 43 may include the tub body 431 provided with the tub introduction port 435 to shield the tub body 41. The tub cover 43 may also include the body coupling portion 433 that extends downward from the cover body 431 and is coupled to the tub body 41. The communication connection portion 9 may be provided at a radial side end of the cover body 431 or at the body coupling portion 433. In addition, the communication connection portion 9 may be provided at a portion at which the body coupling portion 433 extends from the cover body 431. Accordingly, the communication connection portion 9 may be provided at an outermost side of the tub cover 43.

Then, laundry introduced into the drum 5 may be prevented from accessing the communication connection portion 9 by the outer circumferential surface of the drum body 51. That is, access of laundry to the communication connection portion 9 may be prevented by the outer circumferential surface of the upper end of the drum body 51. That is, the communication connection portion 9 may be prevented as much as possible from being clogged by laundry introduced into the drum 5. Accordingly, water may be smoothly supplied into the tub 4 through the inflow portion 6.

Laundry that is introduced into the drum 5 and then washed may generate bubbles in a washing process or foreign substances may be separated from laundry. Then, bubbles generated by laundry or foreign substances separated from laundry may flow into the communication connection portion 9. Foreign substances or bubbles flowing into the communication connection portion 9 may deteriorate a sanitary state of the communication connection portion 9. Furthermore, foreign substances or bubbles may move up to the communication portion 95 to deteriorate a sanitary state of the communication portion 95. Accordingly, it is desirable that bubbles generated by laundry or foreign substances separated from laundry be prevented from flowing into the communication connection portion 9.

The communication connection portion 9 is provided with the above-described structure to prevent bubbles generated by laundry or foreign substances separated from laundry from flowing thereinto as much as possible.

On the other hand, the communication connection portion 9 is desirably located at a higher side than the drum introduction port 53 as much as possible in order to prevent the communication connection portion 9 from being clogged by laundry introduced into the drum 5. The communication connection portion 9 may be provided at the tub cover 43 to be located at a higher side than the drum introduction port 53. In this case, as the communication connection portion 9 is positioned at a higher side, a phenomenon in which the communication connection portion 9 is clogged by laundry may be more efficiently prevented. Increasing the height of the tub cover 43 itself may be one method, but there may be restrictions for space utilization because the height of the tub 4 is smaller than the width of the tub 4. In addition, the tub cover 43 may be provided with the door 45 and the slider 451 to be described later may be provided at the upper portion of the tub cover 43. For this reason, there may be a limit to increasing the height of the tub cover 43 itself.

Accordingly, in the laundry treatment apparatus according to an embodiment of the present disclosure, the communication connection portion may be provided at the side surface of the tub cover and may protrude upward.

The communication connection portion 9 may include a communication guide 91 that is provided by passing through the body coupling portion 433 and is connected to the communication portion 95. The communication connection portion 9 may further include a communication protrusion 92 protruding from the cover body 431 toward the upper surface of the drawer 3. The communication protrusion 92 may be provided with an open lower surface in order to communicate with the inside of the tub 4. One end of the communication guide 91 may be located inside the communication protrusion 92. The communication guide 91 may be connected to the communication portion 95. The inside of the tub 4 may communicate with the outside of the cabinet 2 through the communication guide 91.

The communication protrusion 92 may increase a height at which the communication guide 91 is provided. Thus, a phenomenon in which the communication guide 91 is clogged by laundry may be prevented as much as possible.

The communication protrusion 92 may be provided to protrude while having a cross-sectional area of a predetermined area or more. The communication guide 91 may be provided in the center of the communication protrusion 92.

The cover body 431 may be provided with the slider 451 that is provided with the door 45 and is slidable. The door 45 may be moved away from the slider 451 due to failure or damage. In this case, the communication connection portion 9 may be impacted by the door 45 that is adjacent to the slider 451 and deviates from the slider 451. The communication protrusion 92 protrudes while having a cross-sectional area equal to or greater than a certain area, and the communication guide 91 is provided in the center of the communication protrusion 62 so that damage of the communication guide 61 coupled to the communication portion 95 may be prevented as much as possible. The communication guide 91 may be prevented as much as possible by the communication protrusion 92 from being damaged even by an impact caused by other causes.

The communication guide 91 may extend from one end positioned inside the communication protrusion 92 to the other end connected to the communication portion 95. The communication guide 91 may be provided at one end thereof with a communication hole 912 through which the inside of the tub 4 and the communication portion 95 communicate with each other. The communication guide 91 may extend by passing through the body coupling portion 433. The communication guide 91 may have one end extending from an upper surface of the communication protrusion 92. That is, the upper surface of the communication protrusion 92 may extend up to the other end of the communication guide 91 as one closed surface. Accordingly, the communication guide 91 may be strongly supported by the upper surface of the communication protrusion 92 and the body coupling portion 433.

In addition, an uppermost side of the communication guide 91 may be provided at the cover body 431 to be higher than an uppermost side of the communication protrusion 92. This serves to make the height of the communication guide 91 as large as possible.

The cross section of the communication hole 912 may be provided to face the cross section of the entrance 21. That is, the cross section of the communication hole 612 may be perpendicular to the cross section of the drum introduction port 53. Accordingly, inflow of foreign substances or bubbles into the communication hole 912 may be prevented as much as possible compared to the case in which the cross section of the communication hole 912 is provided in parallel with the cross section of the drum introduction port 53.

If the cross section of the communication hole 912 is provided to face the cross section of the entrance 21, inflow of water into the communication guide 91 due to rise of a water flow caused by rotation of the drum 5 may be prevented as much as possible. In addition, inflow of foreign substances or bubbles into the communication guide 91 due to rise of a water flow caused by rotation of the drum 5 may be prevented as much as possible.

Accordingly, it may be desirable that an internal space of the communication protrusion 92 be sufficiently secured. That is, one end of the communication guide 91 may be provided to be spaced apart from the inner side surface of the communication protrusion 92. This is because the inside of the tub 4 and the outside of the cabinet 22 may communicate with each other to some degrees if the internal space of the communication protrusion 92 is sufficiently secured even though laundry is located inside the communication protrusion 92 or foreign substances flow into the communication protrusion 92. Thus, the inside of the tub 4 and the outside of the cabinet 2 may smoothly communicate with each other through the communication guide 91.

The communication protrusion 92 may be provided to be inclined in a radial direction of the cover body 431. That is, the communication protrusion 92 may be provided to extend from an inner end to an outer end and an upward protrusion length may be more increased at the outer end rather than at the inner end. Alternatively, the communication protrusion 92 may be provided to extend from the inner end to the outer end, and the upward protrusion length may be more increased at the outer end rather than at the inner end and may be constant from a certain point. That is, the communication protrusion 92 may include a communication protrusion inclined portion 921 provided to be inclined in a radial direction of the cover body 431. The communication protrusion 92 may also include a communication protrusion extension 922 extending from the communication protrusion inclined portion 921 to the communication guide 91.

Thereby, even if water inflows into the communication protrusion 92 due to rise of a water flow caused by rotation of the drum 5, water may be guided downward along inclination of the communication protrusion 92. In addition, inflow of water into the communication guide 91 may be prevented as much as possible. Furthermore, inflow of foreign substances or bubbles into the communication guide 91 due to rise of a water flow caused by rotation of the drum 5 may be prevented as much as possible.

The communication connection portion 9 may be desirably minimized if sufficient support force is provided thereto and a smooth communication passage is secured. Then, the diameter of the communication guide 91 may be constant.

Specifically, the communication portion 95 may include a communication external passage 952 communicating with the outside of the communication portion 95. The communication portion 95 may also include a communication tube 951 connected to the communication external passage 952 and up to the communication connection portion 9. The communication tube 951 may be provided as a corrugated tube to prevent the communication tube 951 from being damaged when the drawer 3 is withdrawn. More specifically, the communication guide 91 may be connected to the communication tube 951. A method in which the communication tube 951 and the communication guide 91 are connected may be provided in various ways. For example, the communication tube 951 may be provided to be inserted into the communication guide 91 or may be provided to be connected to the communication guide 91 by a separate member. In addition, the communication guide 91 may be provided to be inserted into the communication tube 951.

That is, the communication guide 91 mainly serves to cause the inside of the tub 4 and the outside of the cabinet 5 to communicate with each other by being coupled to the communication tube 951. Then, the communication guide may not require stronger support force than the inflow guide 61. In other words, the diameter of the communication guide 91 may be equal to the diameter of the first inflow guide 611 so that the diameter may be constantly extended. Therefore, it may be easy to manufacture the communication guide 91. In addition, economic efficiency may be improved and light weight may be achieved in manufacturing the tub cover 43. Furthermore, unnecessary extension of a construction in a limited space inside the drawer 3 may be prevented and an internal space of the drawer 3 may be efficiently utilized.

The highest height of the communication guide 91 may be equal to the highest height of the inflow guide 61. Since it is desirable that the communication guide 91 and the inflow guide 61 be located at an uppermost portion, both the communication guide 91 and the inflow guide 61 may be located at the highest height.

On the other hand, since the laundry treatment apparatus according to an embodiment of the present disclosure is provided in a withdrawable type by the drawer 3, the drawer introduction port 351 and the tub introduction port 435 may be provided to incline towards a front side at which the entrance 21 is disposed. Then, an area in which components are installed at the front side of the drawer body 31 may not be sufficient. In addition, the components provided at the front side of the drawer body 31 may be exposed to the outside.

Accordingly, in the laundry treatment apparatus according to an embodiment of the present disclosure, the communication connection portion 9 may be disposed to be spaced apart from the tub introduction port in a rear direction. Thus, the communication portion 95 may be prevented from being exposed to the outside when the drawer 3 is withdrawn.

Specifically, the communication external passage 952 may be located at a rear side of the laundry treatment apparatus so as to prevent exposure to the outside when the laundry treatment apparatus is installed. The communication tube 951 connecting the communication external passage 952 and the communication connection portion 9 may have one end connected to the communication external passage 952 and the other end connected to the communication connection portion 9. Accordingly, if the communication connection portion 9 is provided at a front side, the length of the communication tube 951 may be increased. In addition, the communication tube 951 may contact other components between the communication connection portion 9 and the communication external passage 952. To prevent this, the communication connection portion 9 may be provided to be spaced apart from the tub introduction port 435 in a rear direction. Thus, the laundry treatment apparatus may be aesthetically excellent and may efficiently use an inner space of the cabinet 2 and an inner space of the drawer 3.

The door 45 for opening and closing the tub introduction port 435 may be provided in a sliding type. Referring to FIGS. 2 and 3, the door 45 may reciprocate forward and backward along the slider 451 provided at the tub introduction port 435. That is, a user may open the tub introduction port 435 by withdrawing the drawer 3 and then sliding the door 45 in a rear direction. The user may then put laundry into the drum 5. As described above, the tub introduction port 435 may be provided at a front side towards which the drawer 3 is withdrawn in order for the user to put laundry into the drum 5. The door 45 for opening and closing the tub introduction port 435 may be provided to reciprocate forward and backward from the front side due to the position of the tub introduction port 435. Accordingly, the slider 451 for allowing the door 45 to reciprocate may be provided to extend from the front side to the rear side of the cover body 431.

Due to the above-described structure, the communication connection portion 9 may be desirably provided to be spaced apart from the tub introduction port 435 in a rear direction. The communication connection portion 9 may be provided to be spaced apart from the tub introduction port 435 in a rear direction by further considering the position of the inflow portion 6 and the position of the water supply tube 71.

Meanwhile, referring to FIG. 14, the communication connection portion 9 may be provided at the tub body 41. If the communication connection portion 9 is provided at the tub body 41, since the drum 5 is accommodated in the tub body 41, the communication connection portion 9 may be prevented from facing the drum introduction port 53. Then, the communication connection portion 9 may be prevented as much as possible from being clogged by laundry introduced into the drum 5.

However, if the communication connection portion 9 is provided at the tub body 41, the height of the communication connection portion 9 from the lower surface of the tub 4 may be desirably greater than the highest water level of the tub body 41. That is, if the communication connection portion 9 is provided to be smaller than the highest water level of the tub body 41, water may flow backward through the communication connection portion 9 during washing, and foreign substances separated from laundry may be introduced.

In addition, if the communication connection portion 9 is provided at the tub body 41, a water flow generated by the rotation of the drum 5 may rise. Then, water may flow backward through the communication connection portion 9, and foreign substances separated from laundry may be introduced. Accordingly, the communication connection portion 9 may be desirably provided at the uppermost end of the tub body 41.

Furthermore, since the tub body 41 is coupled to the body coupling portion 433, the communication connection portion 9 may be provided at a portion at which the tub body 41 and the body coupling portion 433 are connected. In this case, the communication connection portion 9 may be provided with strong supporting force and may be disposed at the uppermost side from the lower surface of the tub body 41.

The communication external passage 952 may be located at a rear side of the laundry treatment apparatus so as to prevent exposure to the outside when the laundry treatment apparatus is installed. The communication tube 951 connecting the communication external passage 952 and the communication connection portion 9 may have one end connected to the communication external passage 952 and the other end connected to the communication connection portion 9. Accordingly, if the communication connection portion 9 is provided at the front side of the tub body 41, the length of the communication tube 951 may be increased. In addition, the communication tube 71 may contact other components between the communication connection portion 9 and the communication external passage 952. To prevent this, the communication connection portion 9 may be provided to be spaced apart from the tub introduction port 435 in a rear direction. That is, the communication connection portion 9 may be provided at the rear side of the tub body 41. Accordingly, the laundry treatment apparatus may be aesthetically excellent and may efficiently use the inner space of the cabinet 2 and the inner space of the drawer 3.

In addition, as described above, the door 45 may reciprocate forward and backward along the slider 451 provided at the tub introduction port 435. That is, a user may open the tub introduction port 435 by withdrawing the drawer 3 and then sliding the door 45 in a rear direction. The user may then put laundry into the drum 5. Thus, if the communication connection portion 9 is provided at the tub body 41, interference with the slider 451 may be prevented.

Meanwhile, the laundry treatment apparatus according to an embodiment of the present disclosure may further include a balancer to reduce vibration generated when the drum rotates. Accordingly, in the laundry treatment apparatus according to an embodiment of the present disclosure, the communication portion may be disposed outside the upper surface of the balancer. A detailed description of the balancer has been given above and thus will be omitted herein.

Referring to FIGS. 15 and 16, the communication connection portion 9 may be provided at the tub cover 43 and may be disposed outside the upper surface of the balancer 52 to prevent the communication connection portion 9 from facing the upper surface of the balancer 52.

Thereby, laundry introduced into the drum 5 may be prevented from accessing the communication connection portion 9 by the outer circumferential surface of the balancer housing 521. That is, access of laundry to the communication connection portion 9 may be prevented by the outer circumferential surface of the upper end of the balancer housing 521. In other words, the communication connection portion 9 may be prevented as much as possible from being clogged by laundry introduced into the drum 5. Accordingly, the tub 4 may smoothly communicate with the outside of the cabinet 2 through the communication connection portion 9.

Laundry that is introduced into the drum 5 and then washed may generate bubbles in a washing process or foreign substances may be separated from laundry. Bubbles generated by laundry or foreign substances separated from laundry may flow into the communication connection portion 9. Foreign substances or bubbles flowing into the communication connection portion 9 may deteriorate a sanitary state of the communication connection portion 9. Furthermore, foreign substances or bubbles may move up to the communication portion 95 to deteriorate a sanitary state of the water communication portion 95. Accordingly, it is desirable that bubbles generated by laundry or foreign substances separated from laundry be prevented from flowing into the communication connection portion 9.

The communication connection portion 9 is provided with the above-described structure to prevent bubbles generated by laundry or foreign substances separated from laundry from flowing thereinto as much as possible.

Meanwhile, referring to FIG. 14, the communication connection portion 9 may be provided at the tub body 41. If the communication connection portion 9 is provided at the tub body 41, since the balancer 52 is accommodated inside the tub body 41, the communication connection portion 9 may be prevented from facing the balancer through hole 527. Accordingly, a phenomenon in which laundry blocks the communication connection portion 9 may be prevented as much as possible by the balancer housing 521.

Referring to FIG. 3, in the laundry treatment apparatus according to an embodiment of the present disclosure, the communication connection portion 9 may be provided to be spaced apart from the inflow portion 6 by a predetermined distance in a circumferential direction of the tub cover 43. That is, if the inflow portion 6 and the communication connection portion 9 are provided to be adjacent to each other, the water supply unit 7 connected to the inflow portion 6 and the communication portion 95 connected to the communication connection portion 9 may be twisted or tangled and thus may be damaged. The inflow portion 6 may be provided with the inflow protrusion 62 and the communication connection portion 9 may be provided with the communication protrusion 92. The tub cover 43 may be provided with the slider 451 for sliding the door 45. Therefore, if the inflow portion 6 and the communication connection portion 9 are provided to be adjacent to each other, it may be difficult to arrange the slider 451. That is, the communication connection portion 9 may be spaced apart from the inflow portion 6 by a predetermined distance in the circumferential direction of the tub cover 43 to easily arrange the slider 45 provided at the tub cover 43 and to facilitate an arrangement relationship with the door 45 reciprocating through the slider 451.

The predetermined distance by which the communication connection portion 9 is spaced apart from the inflow portion 6 in a circumferential direction of the tub cover 43 may be determined in consideration of the position of the water supply unit 7, the position of the communication portion 95, the position of the slider 451, the size of the door 45, and the shape of the door 45.

Referring to FIGS. 12 to 16, the inflow portion 6 is shown as being disposed at the tub cover 43. This is only for convenience of description, and the inflow portion 6 and the communication connection portion 9 may be provided at either the tub cover 43 or the tub body 41. That is, both the inflow portion 6 and the communication connection portion 9 may be provided at the tub body 41. Positions at which the inflow portion 6 and the communication connection portion 9 are provided may be determined by comprehensively considering the size of the drawer 3, the shape of the drawer 3, the size of the tub 4, the shape of the tub 4, and the position of the water supply unit 7, and the position of the communication portion 95.

Referring to FIGS. 12 to 16, in the laundry treatment apparatus according to an embodiment of the present disclosure, the communication portion 95 may include a drain communication tube 77 through which the drain pump 81 and the communication portion 95 communicates with each other.

That is, water stored in the tub 4 is discharged to the outside of the cabinet 2 through the drain unit 8. The drain unit 8 may include a first drain tube 83 for guiding water stored in the tub 4 to the outside of the cabinet 2, a drain pump 81 (controlled by a controller) for discharging water inside the tub 4 to the first drain tube 83, and a second drain tube 85 for guiding water discharged from the pump 81 to the outside of the cabinet 2. In addition, the first drain tube 83 and the second drain tube 85 may be provided as corrugated tubes as the drawer 3 is withdrawn.

However, the drain pump 81 may generate vibration and noise during operation. To prevent this vibration and noise, the communication portion 95 may be provided with the drain communication tube 77 through which the communication portion 95 communicates with the drain pump 81.

That is, the communication portion 95 may be connected to the communication connection portion 9 to cause the inside of the tub 4 and the outside of the cabinet 2 to communicate with each other and is also connected to the drain communication tube 77 to reduce vibration and noise of the drain pump 81. That is, the communication portion 95 may reduce a pressure difference between the inside and the outside of the tub 4 and reduce the vibration and noise of the drain pump 81 while efficiently using an inner space of the drawer 3.

According to embodiments of the present disclosure, a laundry treatment apparatus capable of smoothly supplying water into a tub may be provided by preventing an inflow portion from being clogged by laundry.

According to embodiments of the present disclosure, a laundry treatment apparatus in which the inside of a tub and the outside of a cabinet are capable of smoothly communicating with each other may be provided by preventing a communication connection portion from being clogged by laundry.

According to embodiments of the present disclosure, a laundry treatment apparatus in which a sanitary state is improved may be provided by preventing foreign substances such as bubbles from being discharged to the outside by the inflow portion and the communication connection portion.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treatment apparatus, comprising:

a cabinet that defines an entrance at a front portion thereof;

a drawer configured to be inserted into and withdrawn from the cabinet through the entrance;

a tub disposed inside the drawer and configured to receive water, wherein a height of the tub is less than a width of the tub;

a water supply connected to the tub and configured to supply water to the tub; and a drum comprising a drum body rotatably disposed inside the tub, the drum body having a drum introduction port defined at an upper portion thereof and configured to receive laundry therethrough, wherein the tub comprises:

a tub body that accommodates the drum body, a tub cover that is coupled to an upper surface of the tub body and covers the tub body, the tub cover defining a tub introduction port configured to communicate the drum introduction port with an inner space of the drawer, and an inflow portion disposed at the tub cover and connected to the water supply, the inflow portion being disposed outside the drum introduction port, and wherein the inflow portion extends from a side surface of the tub cover.

2. The laundry treatment apparatus of claim 1, wherein the tub cover comprises:

a cover body that defines the tub introduction port; and a body coupling portion that extends downward from the cover body and is coupled to the tub body, and wherein the inflow portion comprises an inflow guide that passes through the body coupling portion and that is connected to the water supply.

3. The laundry treatment apparatus of claim 2, wherein the inflow portion further comprises an inflow protrusion that protrudes from the cover body toward an upper surface of the drawer, the inflow protrusion having an open lower surface, and wherein a first end of the inflow guide is located inside the inflow protrusion.

4. The laundry treatment apparatus of claim 3, wherein the inflow guide comprises:

a first inflow guide that extends from the first end of the inflow guide and passes through the body coupling portion; and a second inflow guide that extends from the first inflow guide to an outer side of the body coupling portion and is connected to the water supply, and wherein a diameter of the second inflow guide is greater than a diameter of the first inflow guide.

5. The laundry treatment apparatus of claim 4, wherein a height of an upper end of the first inflow guide from a lower surface of the tub is equal to a height of an upper end of the second inflow guide from the lower surface of the tub, and wherein a lower end of the second inflow guide extends outward from the body coupling portion and is disposed below a lower end of the first inflow guide.

6. The laundry treatment apparatus of claim 4, wherein the inflow protrusion is inclined with respect to an upper surface of the cover body and extends in a radial direction of the cover body.

7. The laundry treatment apparatus of claim 2, wherein the inflow portion extends from an upper surface of the cover body.

8. The laundry treatment apparatus of claim 1, wherein the inflow portion is spaced apart from the tub introduction port in a rear direction of the tub and extends toward the water supply, and wherein the water supply is not exposed to an outside of the cabinet in a state in which the drawer is withdrawn.

9. The laundry treatment apparatus of claim 1, further comprising:

a balancer coupled to the drum introduction port and configured to reduce vibration of the drum, the balancer having an open upper surface that is in communication with the drum introduction port and the tub introduction port, wherein the inflow portion is disposed outside the balancer and faces away from the open upper surface of the balancer.

10. The laundry treatment apparatus of claim 1, wherein a height of the inflow portion from a lower surface of the tub body is greater than a predetermined water level of the tub body.

11. The laundry treatment apparatus of claim 1, further comprising a communication portion that communicates the tub with an outside of the cabinet, and wherein the tub further comprises a communication connection portion disposed at the tub body or the tub cover and connected to the communication portion, and wherein the communication connection portion is disposed outside the drum introduction port and faces away from the drum introduction port.

12. The laundry treatment apparatus of claim 11, wherein the communication connection portion extends from a side surface of the tub cover.

13. The laundry treatment apparatus of claim 12, wherein the tub cover comprises:

a cover body that defines the tub introduction port; and a body coupling portion that extends downward from the cover body and is coupled to the tub body, and wherein the communication connection portion comprises a communication guide that passes through the body coupling portion and that is connected to the communication portion.

14. The laundry treatment apparatus of claim 13, wherein the communication connection portion further comprises a communication protrusion that protrudes from the cover body toward an upper surface of the drawer, the communication protrusion having an open lower surface, and wherein a first end of the communication guide is located inside the communication protrusion.

15. The laundry treatment apparatus of claim 11, wherein the communication connection portion is spaced apart from the inflow portion by a predetermined distance in a circumferential direction of the tub cover.

16. The laundry treatment apparatus of claim 11, further comprising:

a balancer coupled to the drum introduction port and configured to reduce vibration of the drum, the balancer having an open upper surface that is in communication with the drum introduction port and the tub introduction port, wherein the communication connection portion is disposed outside the balancer and faces away from the open upper surface of the balancer.

17. The laundry treatment apparatus of claim 11, further comprising:

a drain disposed at the tub and configured to discharge water in the tub to the outside of the cabinet, wherein the drain comprises:

a drain pump disposed at the drawer, a first drain tube configured to guide water in the tub to the drain pump, and a second drain tube configured to guide water discharged from the drain pump to the outside of the cabinet, and wherein the communication portion comprises a drain communication tube connected to the drain pump.

18. The laundry treatment apparatus of claim 11, wherein the communication connection portion extends from an upper surface of the tub cover.

19. The laundry treatment apparatus of claim 11, wherein the inflow portion and the communication connection portion are arranged along a circumference of the tub cover and located rearward relative to the drum introduction port, and wherein the inflow portion and the communication connection portion penetrate an upper surface of the tub cover or a circumferential surface of the tub cover.

* * * * *